US011725902B2

(12) United States Patent
Underwood et al.

(10) Patent No.: US 11,725,902 B2
(45) Date of Patent: Aug. 15, 2023

(54) FOLDING STOCK ASSEMBLIES

(71) Applicants: James Matthew Underwood, Kennesaw, GA (US); Andrew Price Biskup, Dallas, GA (US); Larry Cullen Underwood, Canton, GA (US)

(72) Inventors: James Matthew Underwood, Kennesaw, GA (US); Andrew Price Biskup, Dallas, GA (US); Larry Cullen Underwood, Canton, GA (US)

( * ) Notice: Subject to any disclaimer, the term of this patent is extended or adjusted under 35 U.S.C. 154(b) by 14 days.

(21) Appl. No.: 17/391,578

(22) Filed: Aug. 2, 2021

(65) Prior Publication Data

US 2022/0034625 A1 Feb. 3, 2022

Related U.S. Application Data

(60) Provisional application No. 63/059,212, filed on Jul. 31, 2020.

(51) Int. Cl.
*F41C 23/04* (2006.01)
*F41A 35/06* (2006.01)

(52) U.S. Cl.
CPC ..... *F41C 23/04* (2013.01); *F41A 35/06* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS

| | | | | |
|---|---|---|---|---|
| 3,442,042 | A | 5/1969 | Gilbert | |
| 4,513,523 | A * | 4/1985 | Gal | F41C 23/04 42/72 |
| 4,640,036 | A * | 2/1987 | Gal | F41C 23/00 D22/104 |
| 4,735,007 | A * | 4/1988 | Gal | F41C 23/00 D22/104 |
| 4,766,800 | A * | 8/1988 | Miller | F41A 9/65 89/33.02 |
| 4,788,785 | A | 12/1988 | White | |
| 5,778,588 | A | 7/1998 | Allen, III et al. | |
| 7,162,823 | B2 | 1/2007 | Schoppman et al. | |
| 7,827,721 | B2 | 11/2010 | Griffin | |
| 7,966,761 | B1 * | 6/2011 | Kuczynko | F41C 23/04 42/73 |
| 8,245,429 | B2 * | 8/2012 | Kuczynko | F41C 23/04 42/73 |
| 8,429,844 | B2 | 4/2013 | Dextraze et al. | |
| 8,448,366 | B2 | 5/2013 | Faifer | |

(Continued)

*Primary Examiner* — Michael D David

(57) ABSTRACT

A folding stock assembly for a firearm includes a hinge fitting attached to the firearm, a left hinge pin disposed on a left side of the hinge fitting, a right hinge pin disposed on a right side of the hinge fitting, at least one moving member, a rear housing disposed on a rear side of the hinge fitting, a rearward configuration wherein the rear housing is connected to both the left hinge pin and the right hinge pin, a left side folded configuration wherein the rear housing is connected to the left hinge pin and the rear housing is moved toward a left side of the firearm, and a right side folded configuration wherein the rear housing is connected to the right hinge pin and the rear housing is moved toward a right side of the firearm.

20 Claims, 21 Drawing Sheets

(56) References Cited

U.S. PATENT DOCUMENTS

| | | | | |
|---|---|---|---|---|
| 8,631,601 | B2 * | 1/2014 | Langevin | F41C 23/04 42/73 |
| 8,656,623 | B1 * | 2/2014 | Chvala | F41C 23/04 42/73 |
| 8,667,883 | B1 | 3/2014 | Larson et al. | |
| 8,769,855 | B2 | 7/2014 | Law | |
| 8,820,212 | B2 | 9/2014 | Rostocil | |
| 8,915,005 | B2 | 12/2014 | Grimshaw et al. | |
| 8,991,088 | B1 | 3/2015 | Young | |
| 9,228,786 | B2 | 1/2016 | Sullivan et al. | |
| 9,228,795 | B1 | 1/2016 | Kielsmeier et al. | |
| 9,410,764 | B2 | 8/2016 | Jarboe | |
| 9,488,434 | B2 | 11/2016 | Kielsmeier et al. | |
| D773,593 | S | 12/2016 | Hopkins et al. | |
| 9,546,845 | B2 * | 1/2017 | Mather | F41A 3/66 |
| 9,664,478 | B2 | 5/2017 | Robinson et al. | |
| 9,829,272 | B2 | 11/2017 | Brown | |
| 10,054,393 | B2 | 8/2018 | Kedairy | |
| 10,113,832 | B2 | 10/2018 | Law | |
| 10,156,421 | B2 * | 12/2018 | Smith | F41C 23/14 |
| 10,371,474 | B2 * | 8/2019 | Young | F41A 11/04 |
| 10,443,972 | B1 | 10/2019 | Haugland | |
| 10,704,848 | B1 * | 7/2020 | Zeider | F41A 3/66 |
| 10,900,741 | B2 | 1/2021 | Kielsmeier et al. | |
| 11,143,470 | B1 | 10/2021 | Roth | |
| 11,609,066 | B1 | 3/2023 | Newby et al. | |
| 2006/0242880 | A1 | 11/2006 | Griffin | |
| 2009/0288324 | A1 * | 11/2009 | Peterson | F41C 23/20 42/74 |
| 2011/0131857 | A1 * | 6/2011 | Kuczynko | F41C 23/04 42/73 |
| 2012/0137562 | A1 * | 6/2012 | Langevin | F41C 23/04 42/75.03 |
| 2013/0212920 | A1 | 8/2013 | Law | |
| 2014/0026745 | A1 * | 1/2014 | Lee | F41A 3/78 89/198 |
| 2014/0075815 | A1 * | 3/2014 | Jarboe | F41C 23/06 42/73 |
| 2014/0331539 | A1 * | 11/2014 | Malik | F41C 23/14 42/73 |
| 2014/0360074 | A1 | 12/2014 | Jarboe | |
| 2015/0013203 | A1 | 1/2015 | Lopiccolo | |
| 2016/0202016 | A1 * | 7/2016 | Mather | F41C 23/14 42/73 |
| 2017/0153084 | A1 | 6/2017 | Farazi | |
| 2017/0356712 | A1 * | 12/2017 | Johnson | F41C 7/11 |
| 2018/0195822 | A1 * | 7/2018 | Jonsson | F41A 3/66 |
| 2020/0200505 | A1 * | 6/2020 | Brown, Jr. | F41C 27/00 |
| 2021/0215451 | A1 * | 7/2021 | Ding | F41C 23/14 |
| 2021/0222993 | A1 * | 7/2021 | Morenz | F41C 23/04 |

* cited by examiner

FOLDING STOCK ASSEMBLIES

CROSS REFERENCE TO RELATED APPLICATIONS

This application is related to and claims priority benefit from U.S. Application No. 63/059,212 ("the '212 application"), filed on Jul. 31, 2020. This application is also related to U.S. Provisional Application No. 63/059,217 ("the '217 application"), filed on Jul. 31, 2020. The '217 application and the '212 application are each hereby incorporated in their entirety by this reference.

FIELD OF THE INVENTION

The field of the invention relates to firearms, particularly folding stock assemblies in firearms.

BACKGROUND

Many modern firearms are designed with a collapsible or folding shoulder stock which can make the firearm more compact for storage, carrying, and/or concealment. For example, law enforcement or security details may need firearms with greater capabilities than typical handguns but may also require inconspicuous storage and carrying of such firearms. Conventional concealable firearms include either (i) a collapsing stock, which does not sufficiently reduce the size of the firearm or (ii) a folding stock capable of folding to either the left side or the right side of the firearm.

To increase versatility and options for concealment while improving ergonomics of firearms with a folding stock, it may be desirable to design new ambidextrous folding stock assemblies that include the capability of folding to either the left or the right side of the firearm.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a folding stock assembly for a firearm comprises: a hinge fitting attached to the firearm; a left hinge pin disposed on a left side of the hinge fitting; a right hinge pin disposed on a right side of the hinge fitting; at least one moving member; a rear housing disposed on a rear side of the hinge fitting; a rearward configuration wherein the rear housing is connected to both the left hinge pin and the right hinge pin; a left side folded configuration wherein the rear housing is connected to the left hinge pin and the rear housing is moved toward a left side of the firearm; and a right side folded configuration wherein the rear housing is connected to the right hinge pin and the rear housing is moved toward a right side of the firearm.

According to certain embodiments of the present invention, a folding stock assembly for a firearm comprises: a hinge fitting attached to the firearm; and a plurality of hinge pins extending through at least a portion of the hinge fitting, wherein the ambidextrous folding stock assembly is configured to rotate in a different direction about each of the plurality of hinge pins.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-13B show components of the AR-15 variant (civilian) or M16/M4 (military) firearm platform (i.e. AR-15 style rearms), the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge. Further, the term "stock" encompasses firearm stocks, firearm braces, firearm buttstocks, firearm arm braces, and/or other devices designed to improve ergonomics and/or facilitate interfaces between a rear portion of a firearm and an operator's body.

In some embodiments, a firearm may include a folding stock assembly 1000 and a stock 150. The folding stock assembly 1000 may be fully ambidextrous such that the stock 150 can move based on the folding stock assembly 1000 moving between (i) the rearward configuration shown in FIGS. 1 and 2, (ii) the left side folded configuration shown in FIGS. 3A and 3B, (iii) the right side folded configuration shown in FIGS. 4A and 4B, and an infinite number of configurations between these illustrated configurations (i.e., various partially folded configurations).

As shown in FIGS. 1-4B, the folding stock assembly 1000 may include a hinge fitting 1001, a left hinge pin 1003, a right hinge pin 1004, at least one moving member, an operating rod 1151, and a rear housing 1201. In some embodiments, the at least one moving member includes a left side moving member 1051 and a right side moving member 1101. The left side moving member 1051 and the right side moving member 1101 may be identical to simplify manufacturing and assembly of the folding stock assembly 1000.

Figure 1:
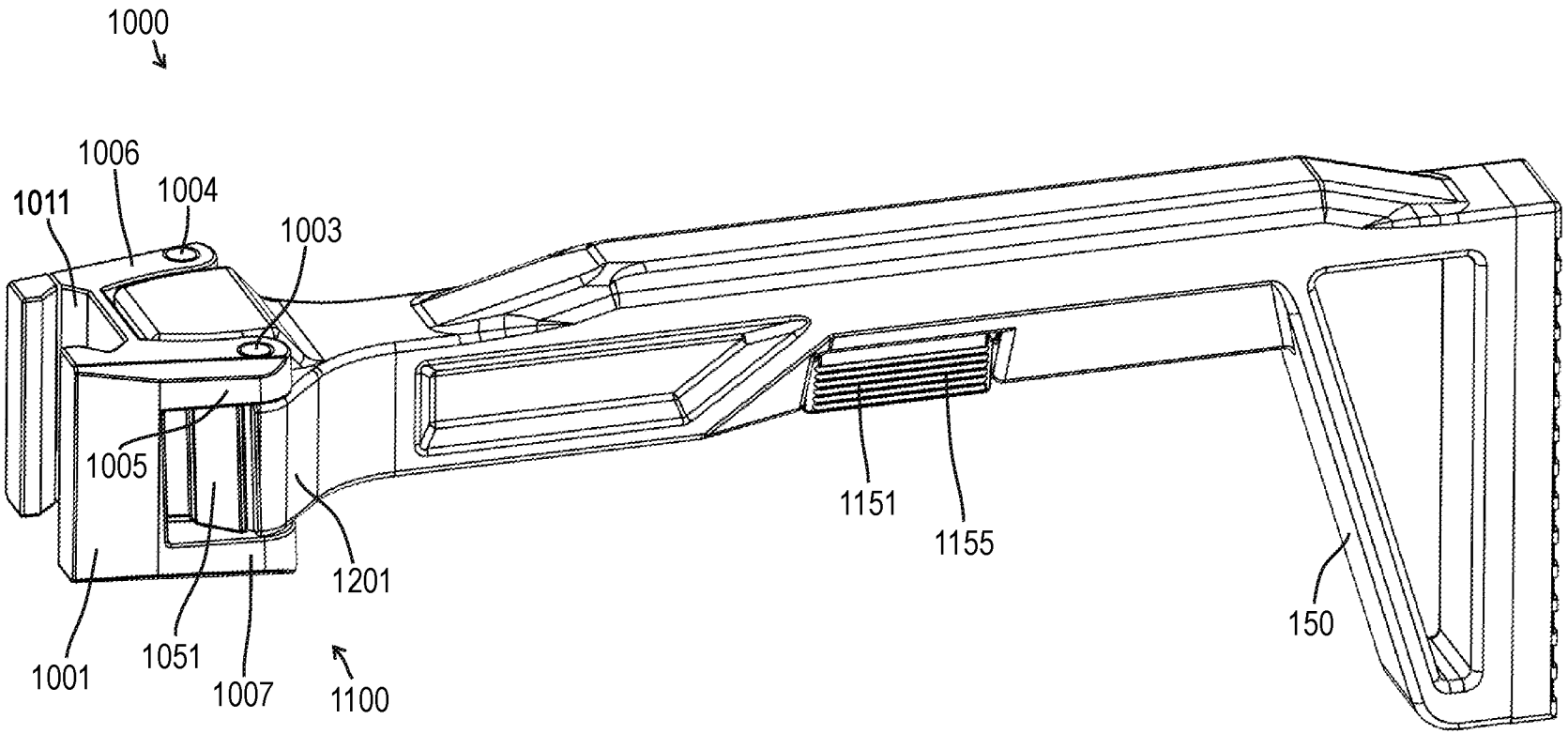
FIG. 1 is a left perspective view of a folding stock assembly according to certain embodiments of the present invention.
Figure 2:
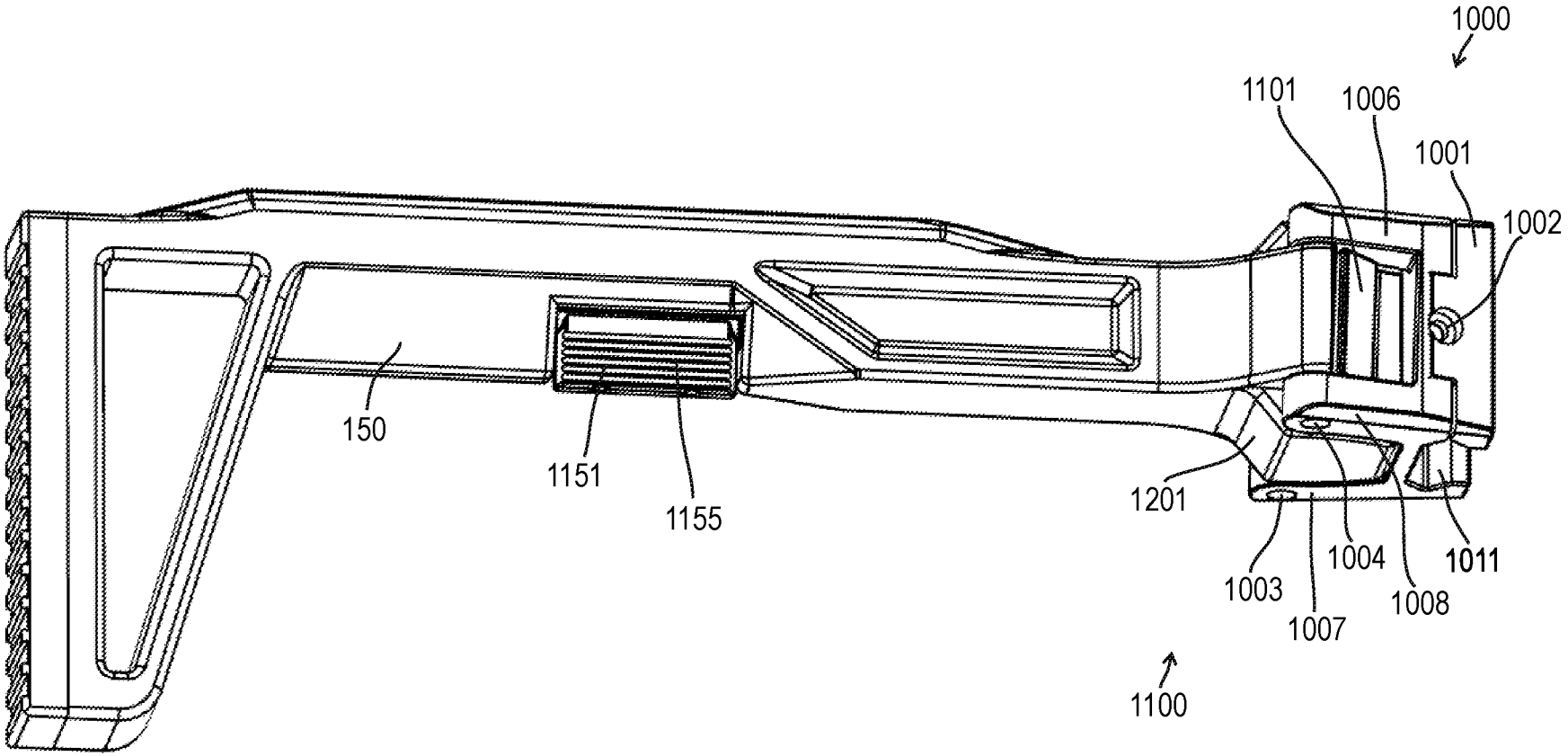
FIG. 2 is a right perspective view of the folding stock assembly of FIG. 1.
Figure 8:
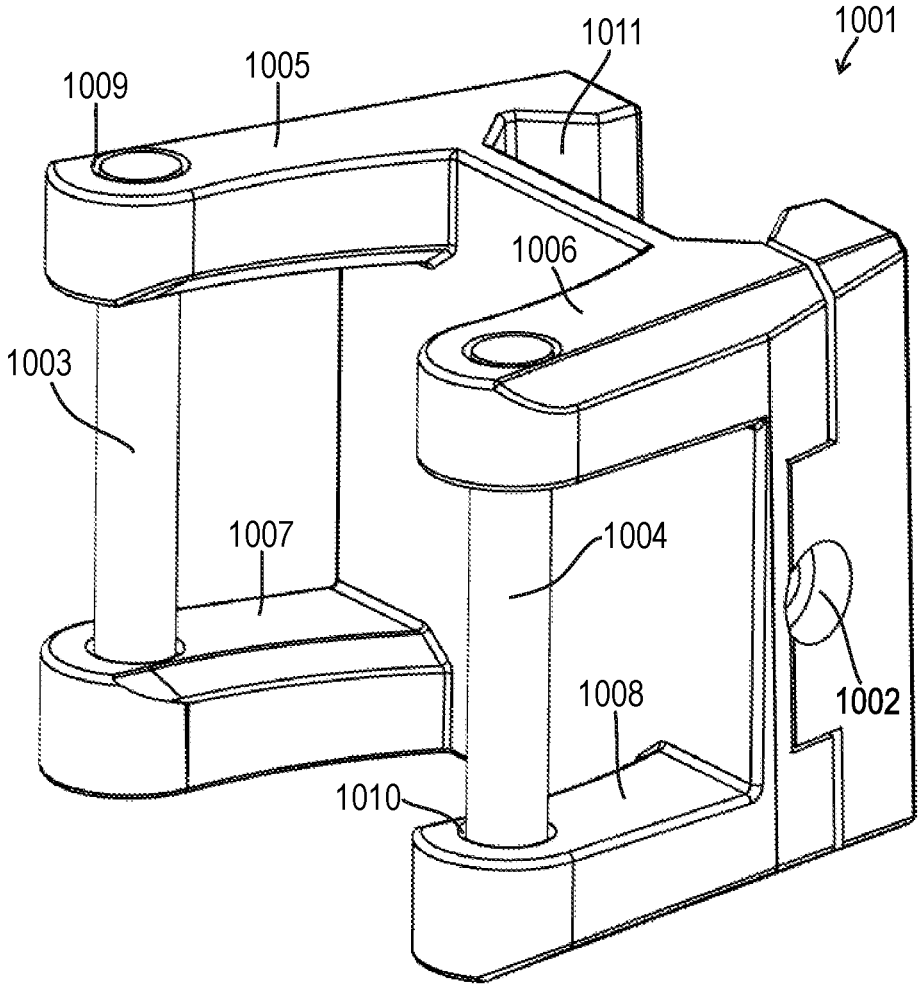
FIG. 8 is a rear perspective view of a hinge fitting of the folding stock assembly of FIG. 1.
Figure 9A:
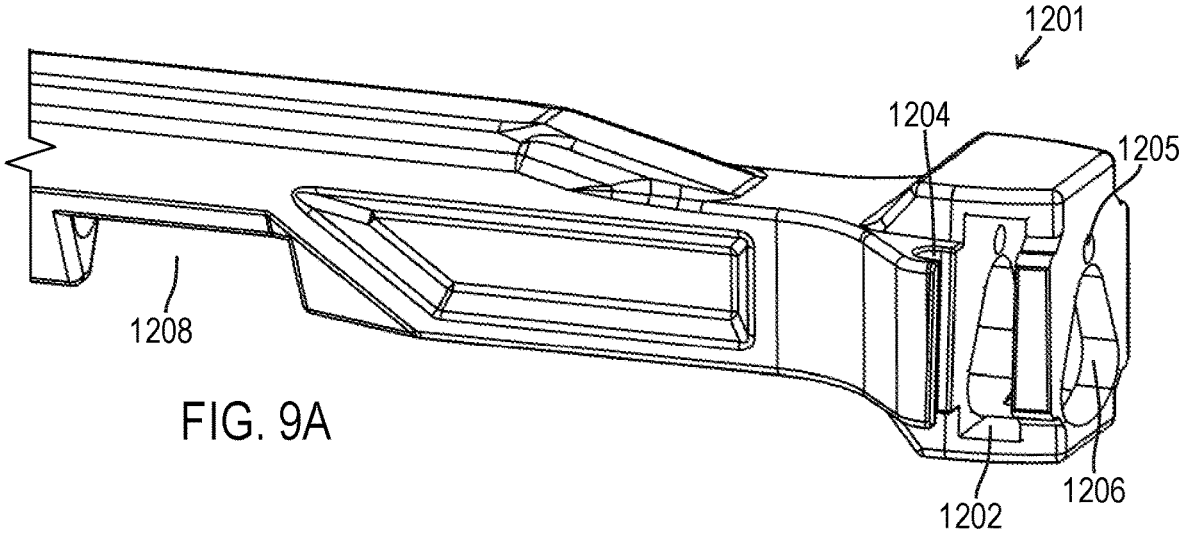
FIG. 9A is a left partial perspective view of a rear housing of the folding stock assembly of FIG. 1.
Figure 9B:
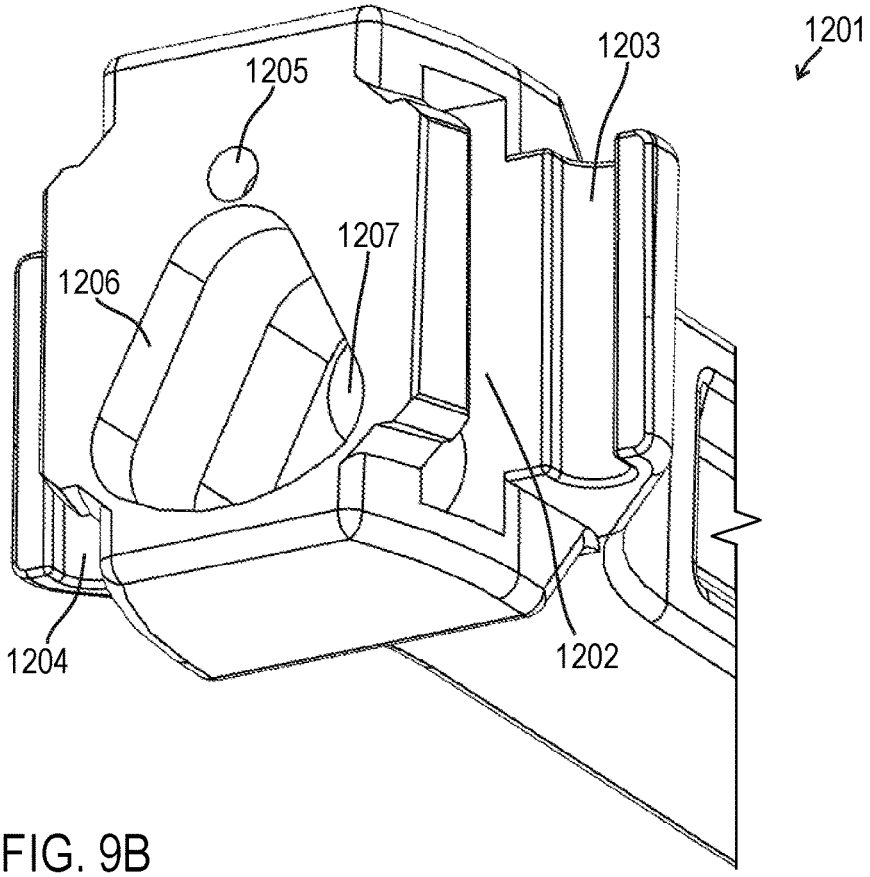
FIG. 9B is a front partial perspective view of the hinge fitting of FIG. 9A.
Figure 10A:
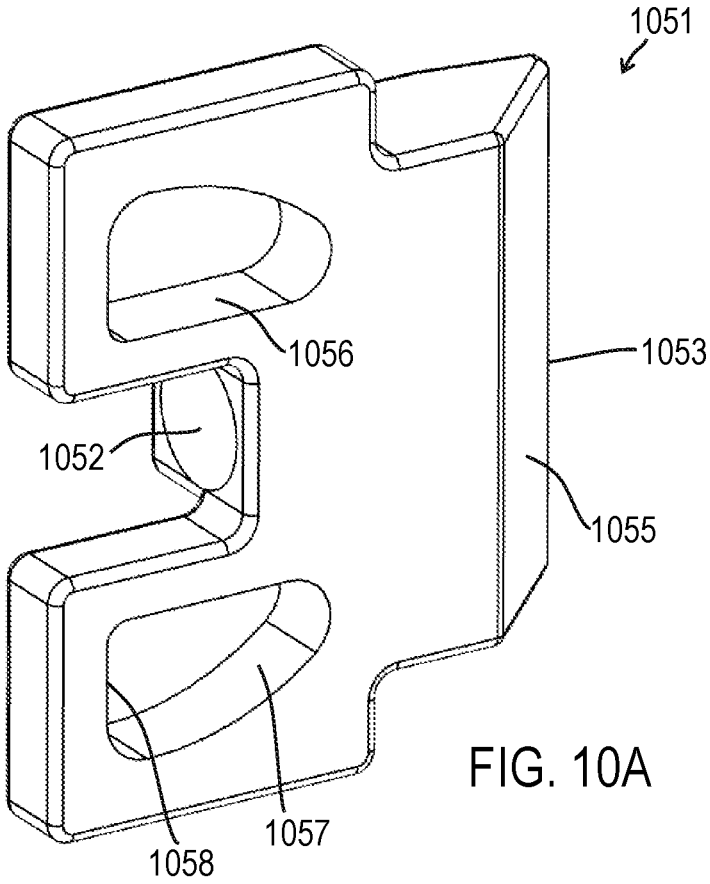
FIG. 10A is a rear perspective view of a left side moving member of the folding stock assembly of FIG. 1.
Figure 10B:
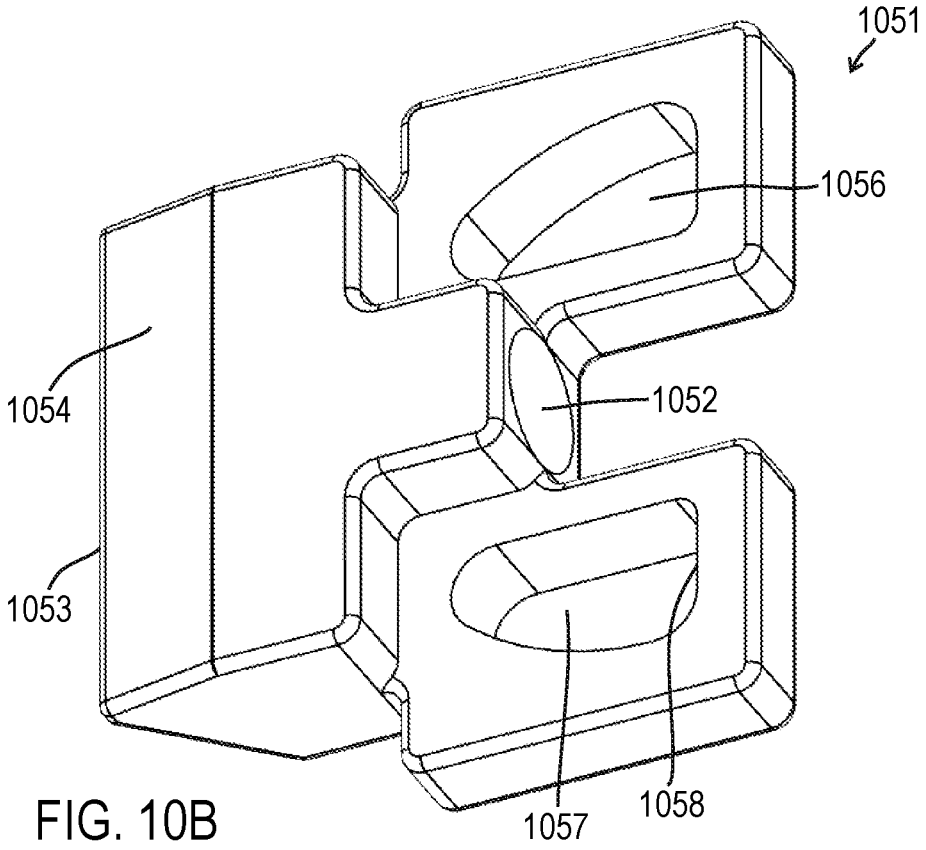
FIG. 10B is a front perspective view of the left side moving member of FIG. 10A.
Figure 11A:
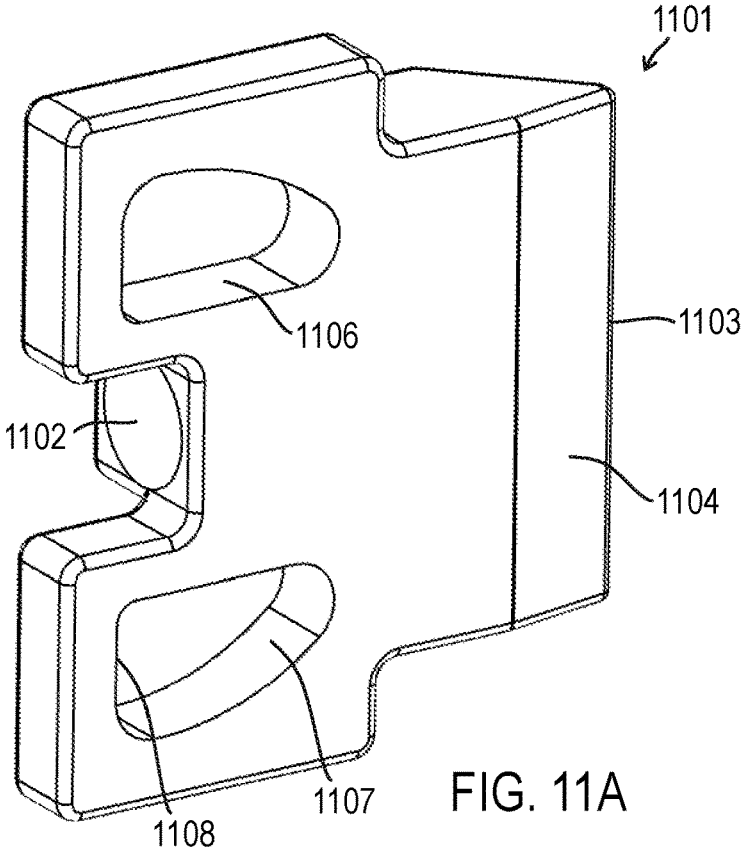
FIG. 11A is a front perspective view of a right side moving member of the folding stock assembly of FIG. 1.
Figure 11B:
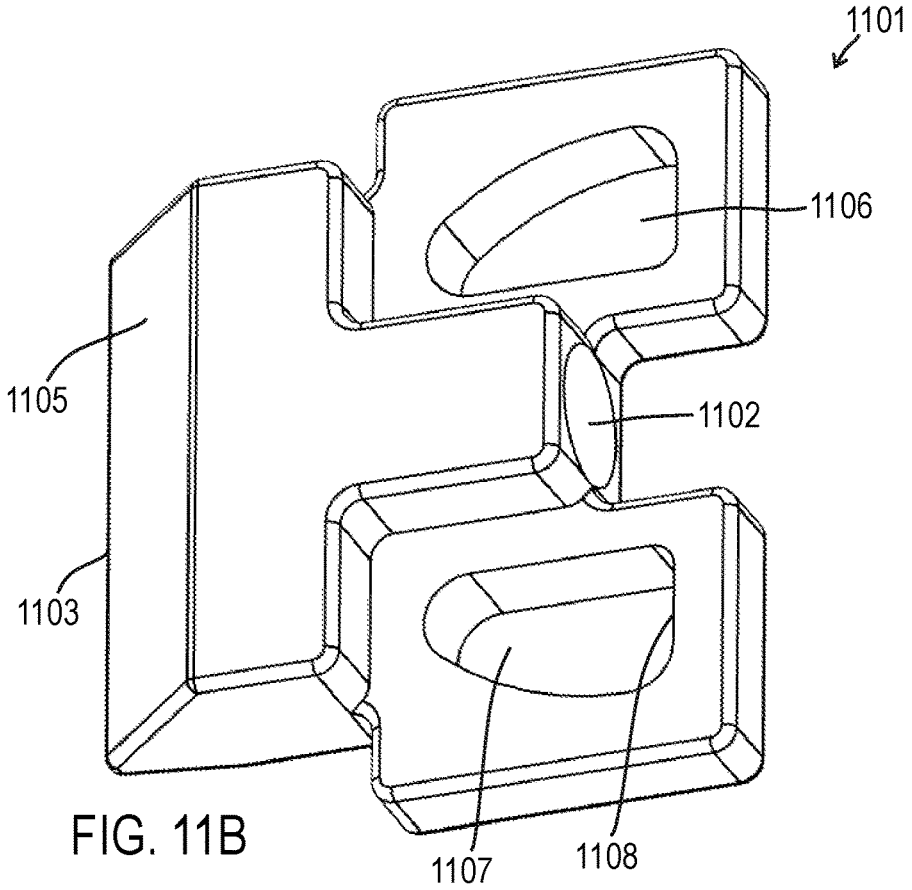
FIG. 11B is a rear perspective view of the right side moving member of FIG. 11A.

The hinge fitting 1001, as shown in FIGS. 1-2, may be removably attached to other portions of the firearm (e.g., to a lower receiver). However, in other embodiments, the hinge fitting 1001 is a permanent or integral component of the firearm. The hinge fitting 1001 may include an attachment portion 1011. In some cases, the attachment portion 1011 is a picatinny rail or weaver rail attachment with a fastener hole 1002 for adjusting or securing attachment. As shown in FIG. 8, on the rear side, the hinge fitting 1001 may include an upper left lug 1005, an upper right lug 1006, a lower left lug 1007, a lower right lug 1008, a left pivot hole 1009, and a right pivot hole 1010. In some cases, the left pivot hole 1009 extends through both the upper left lug 1005 and the lower left lug 1007. Similarly, the right pivot hole 1010 may extend through both the upper right lug 1006 and the lower right lug 1008. The left hinge pin 1003 may be inserted into left pivot hole 1009 (in some cases permanently while in other cases removably). The right hinge pin 1004 may be inserted into right pivot hole 1010 (in some cases permanently while in other cases removably).

The rear housing 1201, as shown in FIGS. 1-2, may be attached to other portions of the firearm (e.g., to the stock 150). In some embodiments, the rear housing 1201 is removably attached to the stock 150. As shown in FIGS. 5A-5C, 9A, and 9B, the rear housing 1201 may include a cavity 1202, a left pivot hole 1203, a right pivot hole 1204, an upper stud hole 1205, a forward opening 1206, a passage 1207, and a recess 1208. The cavity 1202 may be configured such that one or both of the left side moving member 1051 and the right side moving member 1101 are disposed therein. In some cases, the cavity 1202 extends through a full width of the rear housing 1201 and intersects the left pivot hole 1203 and/or the right pivot hole 1204. The optional forward opening 1206 may provide clearance and/or access to the left side moving member 1051 and the right side moving member 1101 along with the related mechanism, which is described in greater detail below. In some embodiments, the operating rod 1151 is disposed within the passage 1207 while the paddle 1155 is at least partially disposed in the recess 1208.

The folding stock assembly 1000 may include one or more features to align the moving members 1051, 1101 with the rear housing 1201. For example, the folding stock assembly 1000 may include an upper stud 1351 located within the hole 1205 that passes through opening 1056 of left side moving member 1051 and opening 1106 of the right side moving member 1101. The folding stock assembly 1000 may also include a lower stud 1352 disposed within hole 1153 of the operating rod 1151 where the lower stud 1352 extends forward and passes through opening 1057 of left side moving member 1051 and opening 1107 of the right side moving member 1101.

Figure 3A:
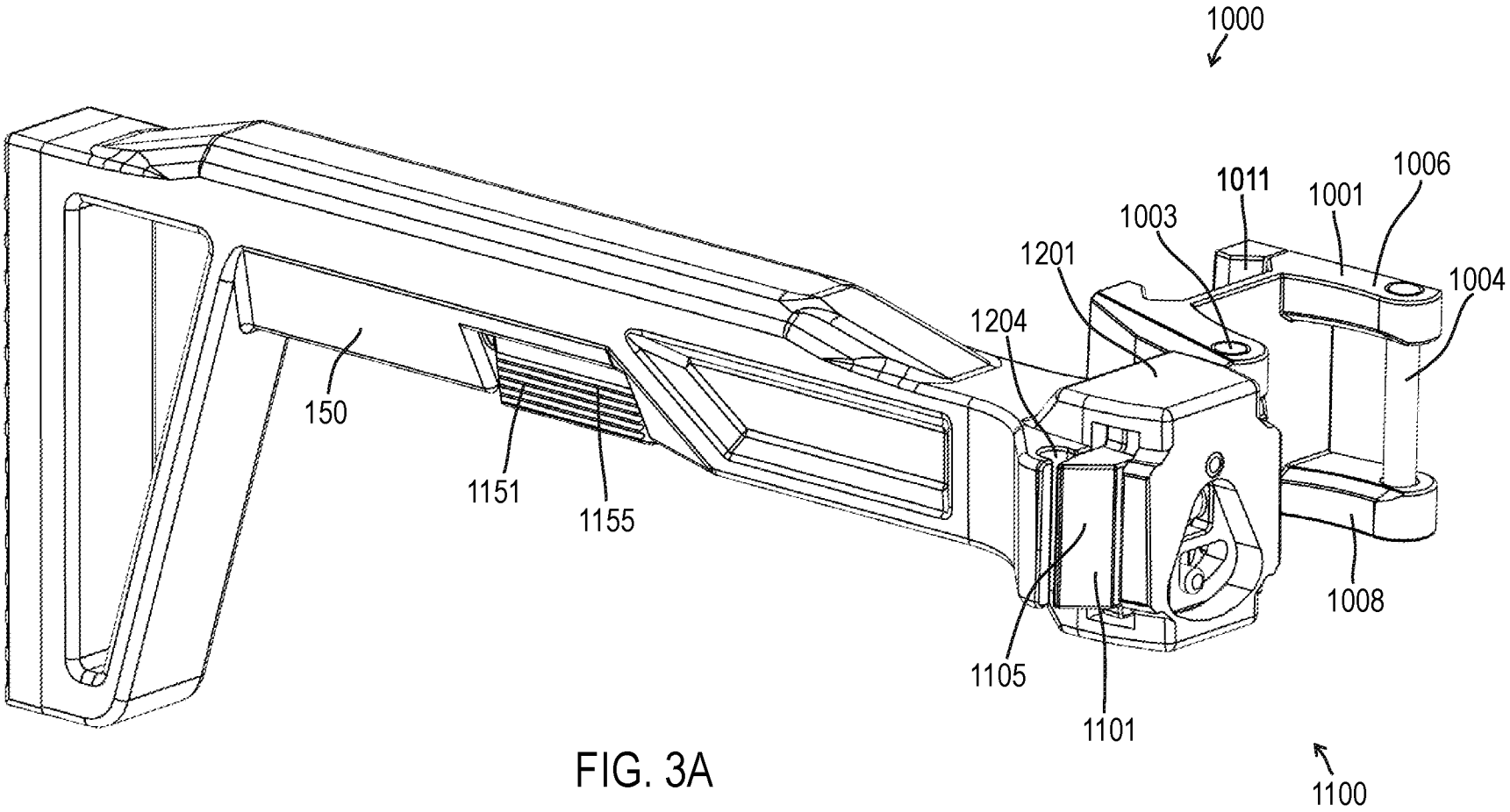
FIG. 3A is a left perspective view of the folding stock assembly of FIG. 1 in a left side folded configuration.
Figure 3B:
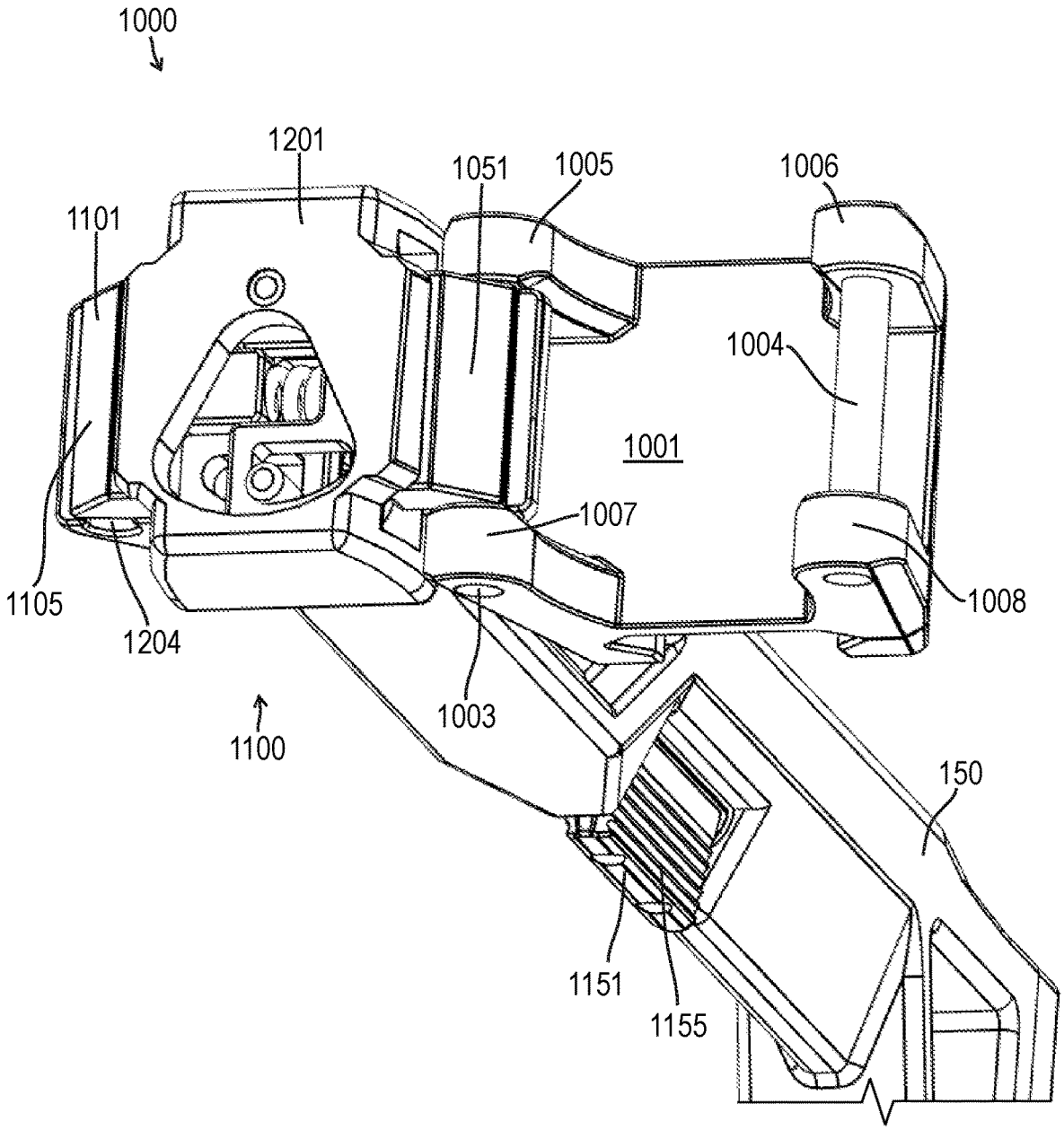
FIG. 3B is a rear perspective view of the folding stock assembly of FIG. 3A.

In some embodiments, the left pivot hole 1203 is coaxial with the left hinge pin 1003 and the left pivot hole 1009 when the folding stock assembly 1000 is in the rearward configuration (see FIGS. 1 and 2) and in the left side folded configuration (see FIGS. 3A and 3B). The right pivot hole 1204 may be coaxial with the right hinge pin 1004 and the right pivot hole 1010 when the folding stock assembly 1000 is in the rearward configuration (see FIGS. 1 and 2) and in the right side folded configuration (see FIGS. 4A and 4B).

In addition to the rotational movement that occurs between the various configurations illustrated in FIGS. 1-4B, the folding stock assembly 1000 may include a fold lock mechanism 1100 that allows limited movement in at least one more direction to constrain and/or control the rotational movement. In some embodiments, the fold lock mechanism 1100 allows horizontal movement of at least one of the left side moving member 1051 and the right side moving member 1101. The horizontal movement may be based on a rotational movement of the operating rod 1151.

Figure 7A:
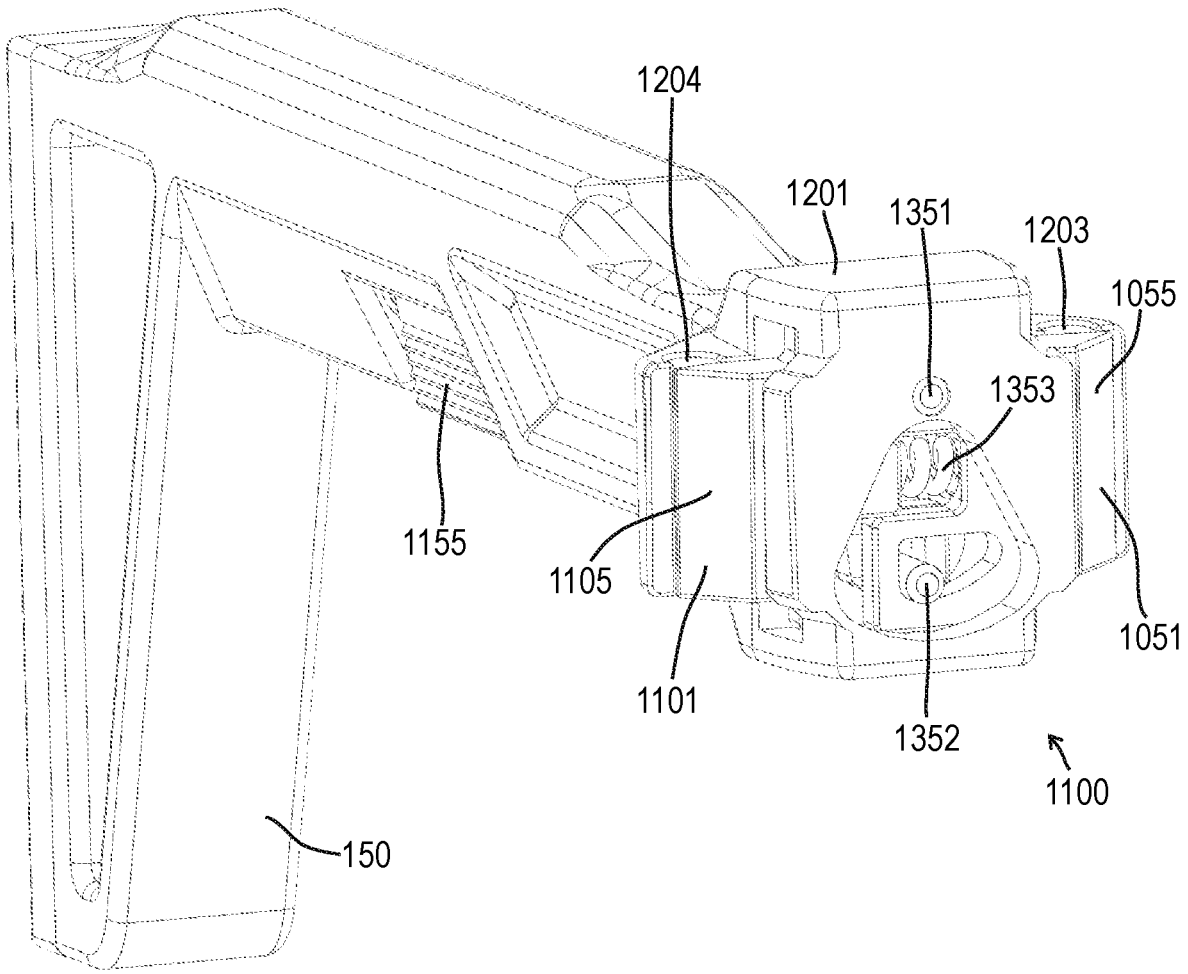
FIG. 7A is a right perspective view of the folding stock assembly of FIG. 1 with a fold lock mechanism in a retracted configuration.
Figure 7B:
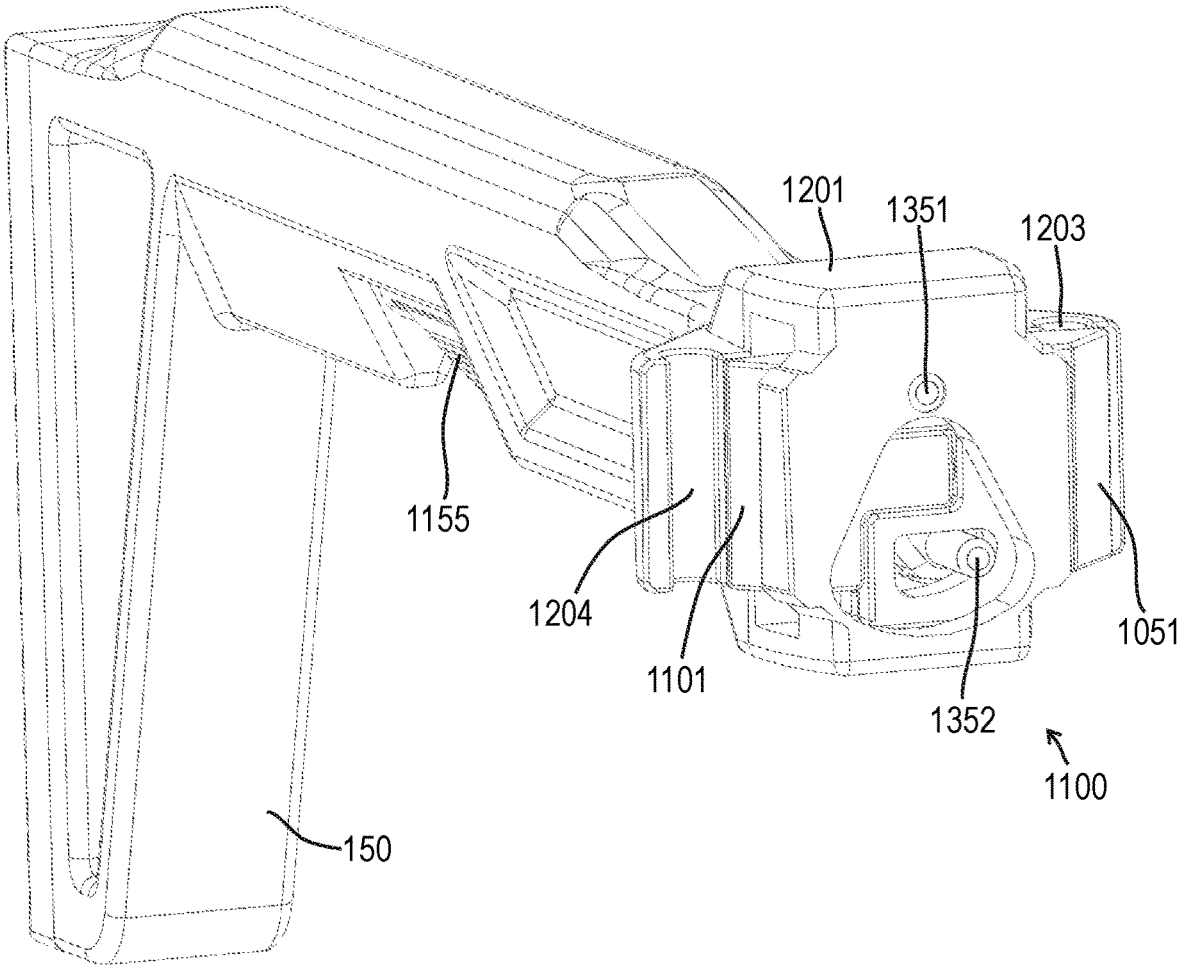
FIG. 7B is a right perspective view of the folding stock assembly of FIG. 1 with a fold lock mechanism in a left deployed configuration.
Figure 7C:
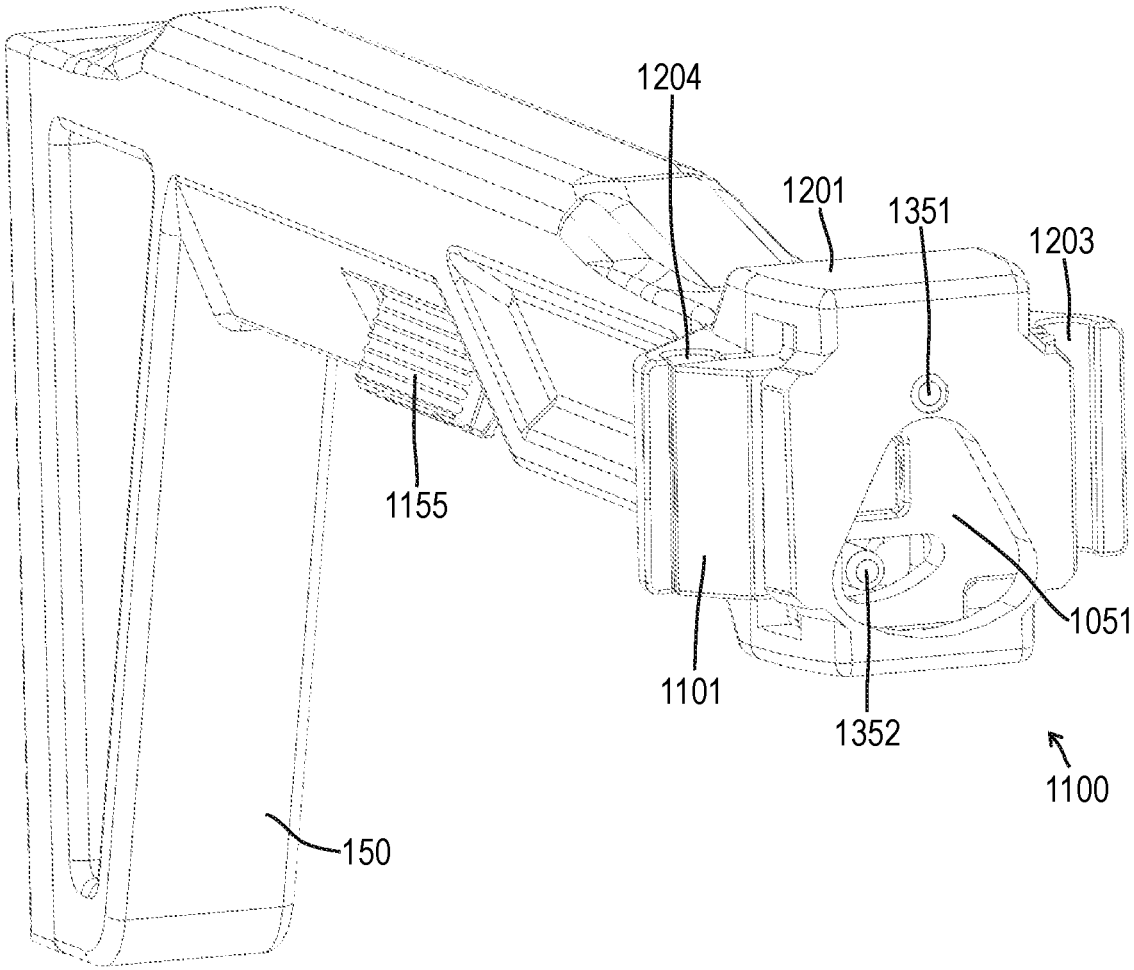
FIG. 7C is a right perspective view of the folding stock assembly of FIG. 1 with a fold lock mechanism in a right deployed configuration.

Movement of the fold lock mechanism 1100 is shown in FIGS. 7A-7C. A retracted configuration (i.e., the default position) of the fold lock mechanism 1100 is shown in FIG. 7A. In some embodiments, in the retracted configuration, the left side moving member 1051 and the right side moving member 1101 are biased outboard away from one another in the horizontal direction (e.g., due to spring 1353). In particular, a spring 1353 is located and extends between a hole 1052 of the left side moving member 1051 and a hole 1102 of the right side moving member 1101 (see FIGS. 10A-11B). As shown in FIG. 7A, in the retracted configuration, the left side moving member 1051 is in an outboard position such that it interfaces with and/or covers the opening of the left pivot hole 1203 and the right side moving member 1101 is in an outboard position such that it interfaces with and/or covers the opening of the right pivot hole 1204. In some cases, in the retracted configuration, the paddle 1155 of the operating rod 1151 is oriented in an approximately vertical/downward direction. The retracted configuration of the fold lock mechanism 1100 merely refers to the horizontal position of the moving members 1051, 1101 along with the rotational position of the operating rod 1151 and can occur in multiple rotational configurations of the folding stock assembly 1000.

The operating rod 1151 may include multiple protrusions including, for example, a forward protrusion 1152 (for interfacing with moving members 1051, 1101) and a paddle 1155 (for receiving input from an operator).

Figure 12A:
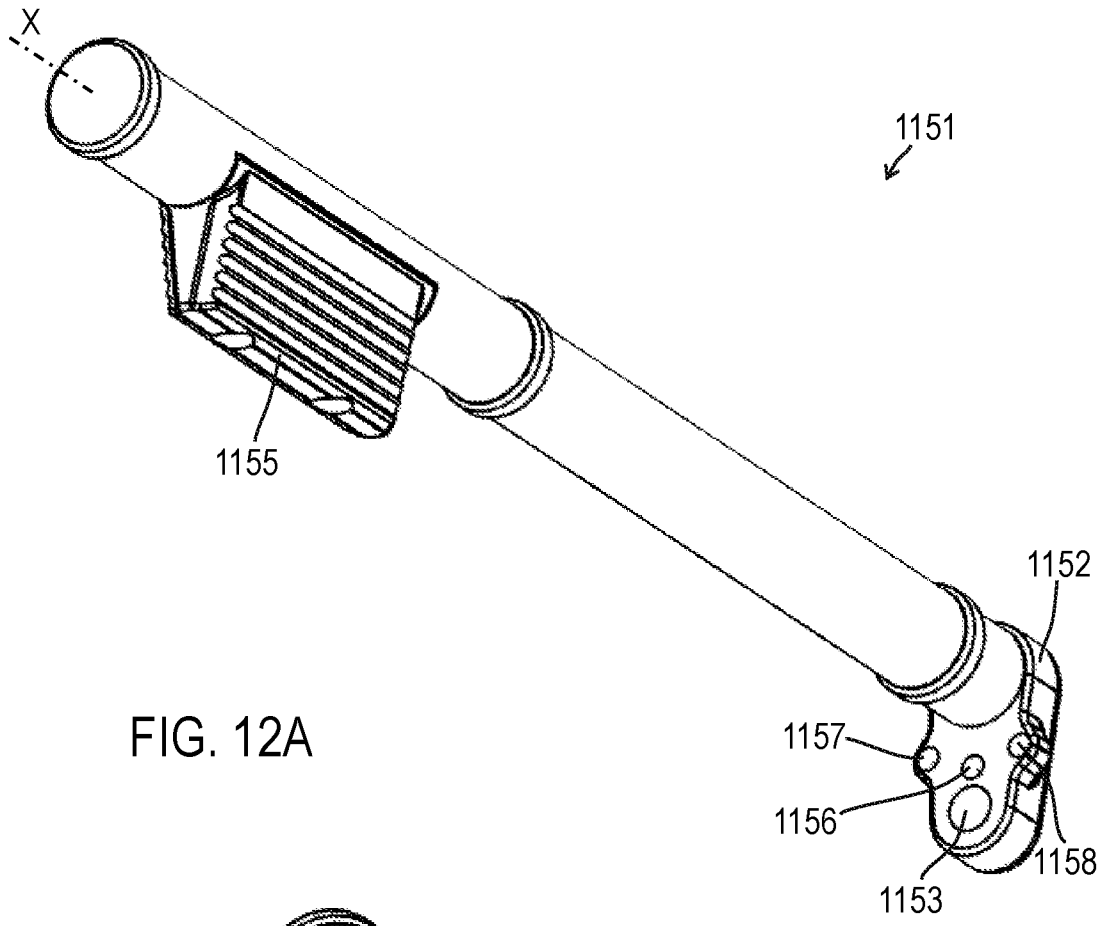
FIG. 12A is a rear perspective view of an operating rod of the folding stock assembly of FIG. 1.
Figure 12B:
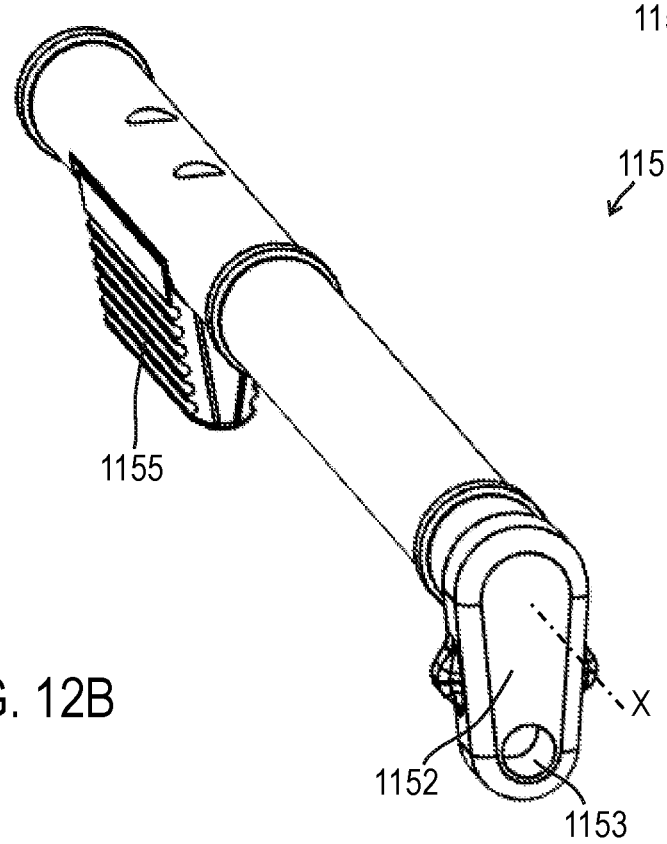
FIG. 12B is a front perspective view of the operating rod of FIG. 12A.

FIG. 7B illustrates a left side deployed configuration of the fold lock mechanism 1100. In some embodiments, to move the fold lock mechanism 1100 from the retracted configuration (FIG. 7A) to the left side deployed configuration (FIG. 7B), the operator pushes the paddle 1155 of the operating rod 1151 toward the left side of the firearm (i.e., when looking forward) such that the operating rod 1151 rotates. As shown in FIG. 7B, in the left side deployed configuration, the operating rod 1151 rotates about axis X (i.e., due to pressure applied to paddle 1155), which causes forward protrusion 1152 to rotate such that hole 1153 rotates. The axis X is shown in FIGS. 12A and 12B. In some embodiments, the lower stud 1352 is disposed within hole 1153. Accordingly, rotation of the paddle 1155 causes a corresponding rotation of the lower stud 1352 (see FIG. 7B) where the lower stud 1352 pulls the right side moving member 1101 toward the left side of the firearm away from the right pivot hole 1204. In particular, the lower stud 1352 extends forward from the forward protrusion 1152 and passes through opening 1107 of the right side moving member 1101 such that rotation of the lower stud 1352 toward the left side of the firearm includes direct contact between the lower stud 1352 and internal surface 1108 of the opening 1107 (which causes right side moving member 1101 to move toward the left side of the firearm and compress spring 1353). As shown in FIG. 7B, movement of the lower stud 1352 toward the left side of the firearm includes movement of the lower stud 1352 within opening 1057 of the left side moving member 1051 without causing movement of the left side moving member 1051. When the operator holds the fold lock mechanism 1100 in the left side deployed configuration, the rear housing 1201 and the stock 150 can pivot about the left pivot hole 1203 (which remains coaxial with the left hinge pin 1003 and the left pivot hole 1009) because the movement of the right side moving member 1101 allows the right pivot hole 1204 to separate from the right hinge pin 1004.

FIG. 7C illustrates a right side deployed configuration of the fold lock mechanism 1100. In some embodiments, to move the fold lock mechanism 1100 from the retracted configuration (FIG. 7A) to the right side deployed configuration (FIG. 7C), the operator pushes the paddle 1155 of the operating rod 1151 toward the right side of the firearm (i.e., when looking forward) such that the operating rod 1151 rotates. As shown in FIG. 7C, in the right side deployed configuration, the operating rod 1151 rotates about axis X (i.e., due to pressure applied to paddle 1155), which causes forward protrusion 1152 to rotate such that hole 1153 rotates. In some embodiments, a lower stud 1352 is disposed within hole 1153. Accordingly, rotation of the paddle 1155 causes a corresponding rotation of the lower stud 1352 (see FIG. 7C) where the lower stud 1352 pulls the left side moving member 1051 toward the right side of the firearm away from the left pivot hole 1203. In particular, the lower stud 1352 extends forward from the forward protrusion 1152 and into opening 1057 of the left side moving member 1051 such that rotation of the lower stud 1352 toward the right side of the firearm includes direct contact between the lower stud 1352 and internal surface 1058 of the opening 1057 (which causes left side moving member 1051 to move toward the right side of the firearm and compress spring 1353). Movement of the lower stud 1352 toward the right side of the firearm may also include movement of the lower stud 1352 within opening 1107 of the right side moving member 1101 without causing movement of the right side moving member 1101. When the operator holds the fold lock mechanism 1100 in the right side deployed configuration, the rear housing 1201 and the stock 150 can pivot about the right pivot hole 1204 (which remains coaxial with the right hinge pin 1004 and the right pivot hole 1010) because the movement of the left side moving member 1051 allows the left pivot hole 1203 to separate from the left hinge pin 1003.

The fold lock mechanism 1100 may allow an operator to control movement between the various rotational configurations described above (the rearward configuration, the left side folded configuration, the right side folded configuration, and the partially folded configurations), including those shown in FIGS. 1-4B. As described above, the fold lock mechanism 1100 includes (i) the retracted configuration in which rotational movement of the components of the folding stock assembly 1000 is constrained/limited (see, e.g., FIG. 7A); (ii) the left side deployed configuration (see FIG. 7B) where (based on operator input) the components of the folding stock assembly 1000 can move and/or rotate relative to one another toward the left side of the firearm (see, e.g., FIGS. 3A and 3B); and (iii) the right side deployed configuration (see FIG. 7C) where (based on operator input) the components of the folding stock assembly 1000 can move and/or rotate relative to one another toward the right side of the firearm (see, e.g., FIGS. 4A and 4B).

The folding stock assembly 1000 may include at least one feature for holding or securing the fold lock mechanism 1100 in a given configuration. For example, the forward protrusion 1152 of the operating rod 1151 may include at least one detent interface (e.g., 1156-1158 shown in FIG. 12A) and the rear housing 1201 may include a corresponding detent feature located in cavity 1154 (see FIGS. 5A and 5B). The rear housing 1201 may include a detent and spring located in cavity 1154. The forward protrusion 1152 of the operating rod 1151 may include a first detent interface 1156 that corresponds to the retracted configuration, a second interface 1157 that corresponds to the right side deployed configuration, and a third interface 1158 that corresponds to the left side deployed configuration. In some cases, the detent interfaces 1156-1158 are each a cavity or recess for engaging a detent.

Figure 4A:
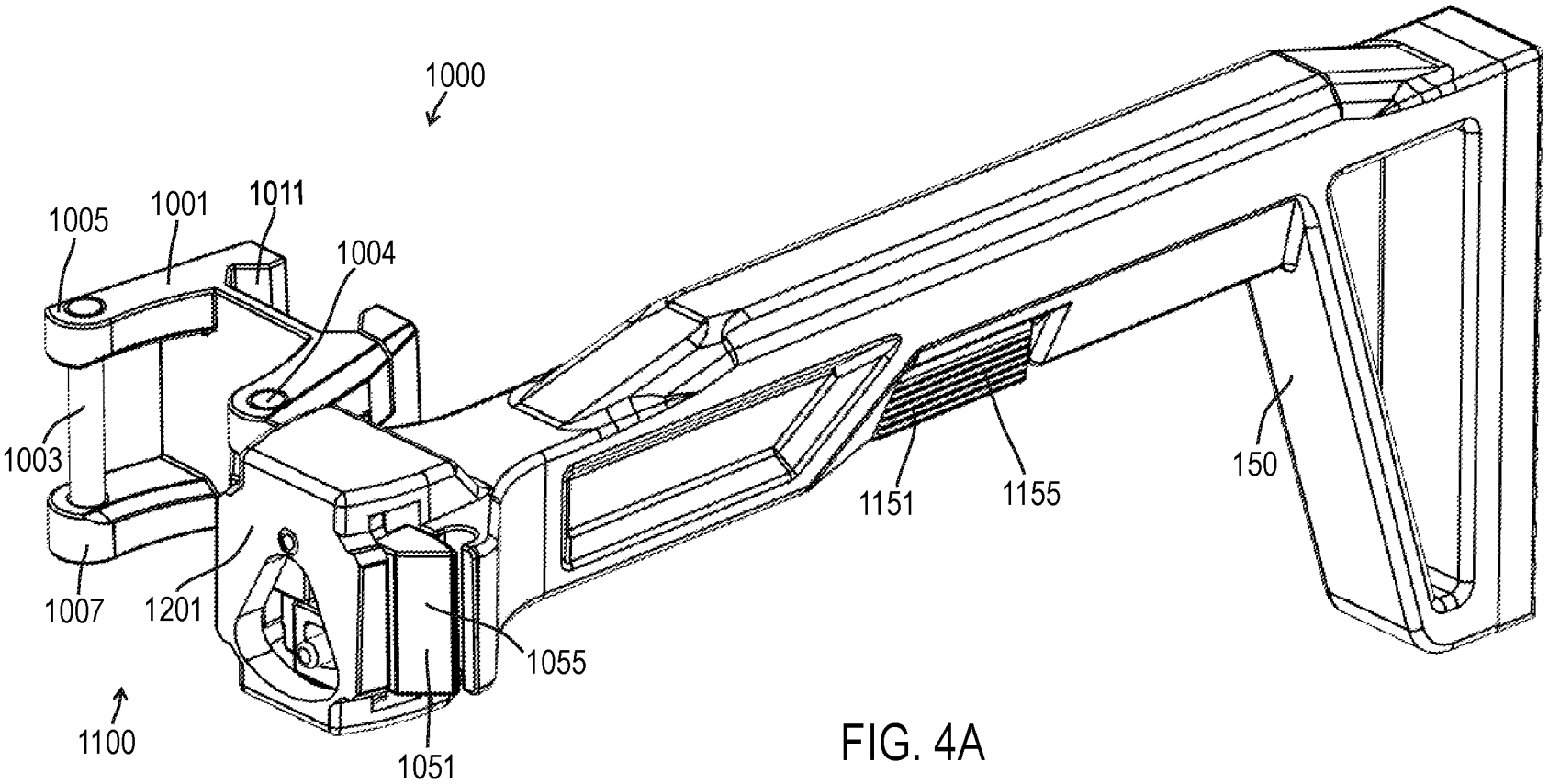
FIG. 4A is a right perspective view of the folding stock assembly of FIG. 1 in a right side folded configuration.
Figure 4B:
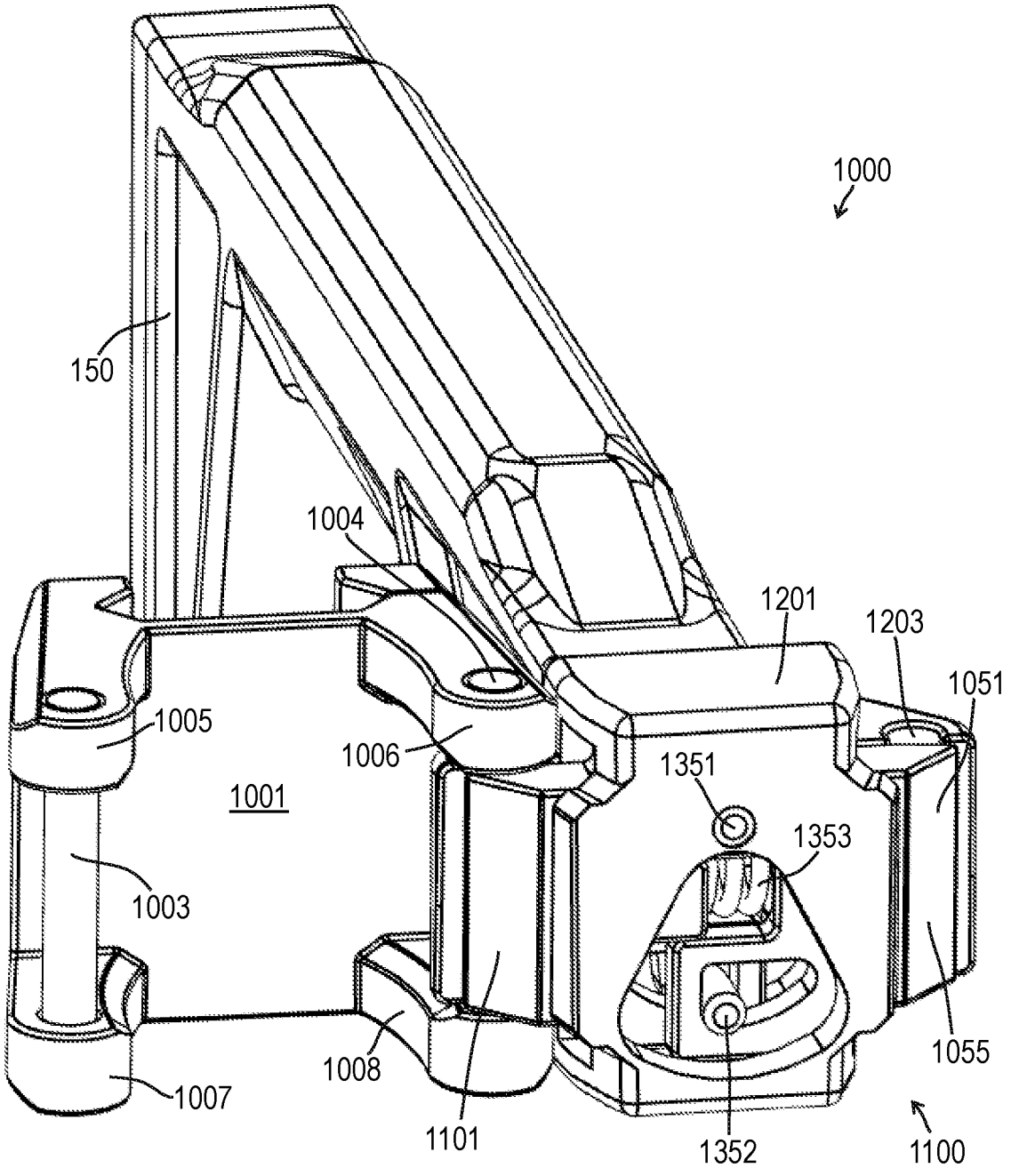
FIG. 4B is a rear perspective view of the folding stock assembly of FIG. 4A.
Figure 5A:
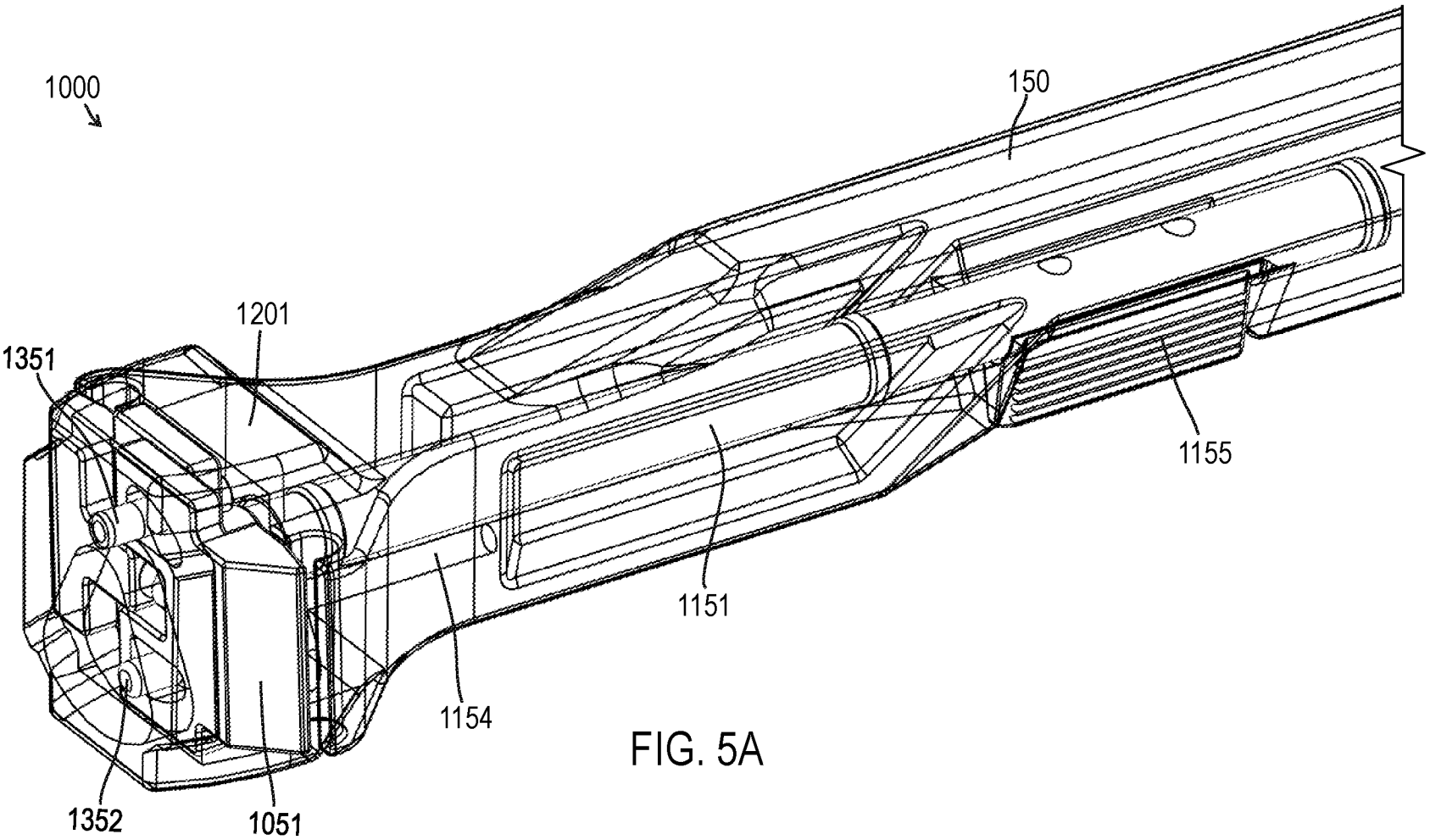
FIG. 5A is a left partial perspective view of folding stock assembly of FIG. 1.
Figure 5B:
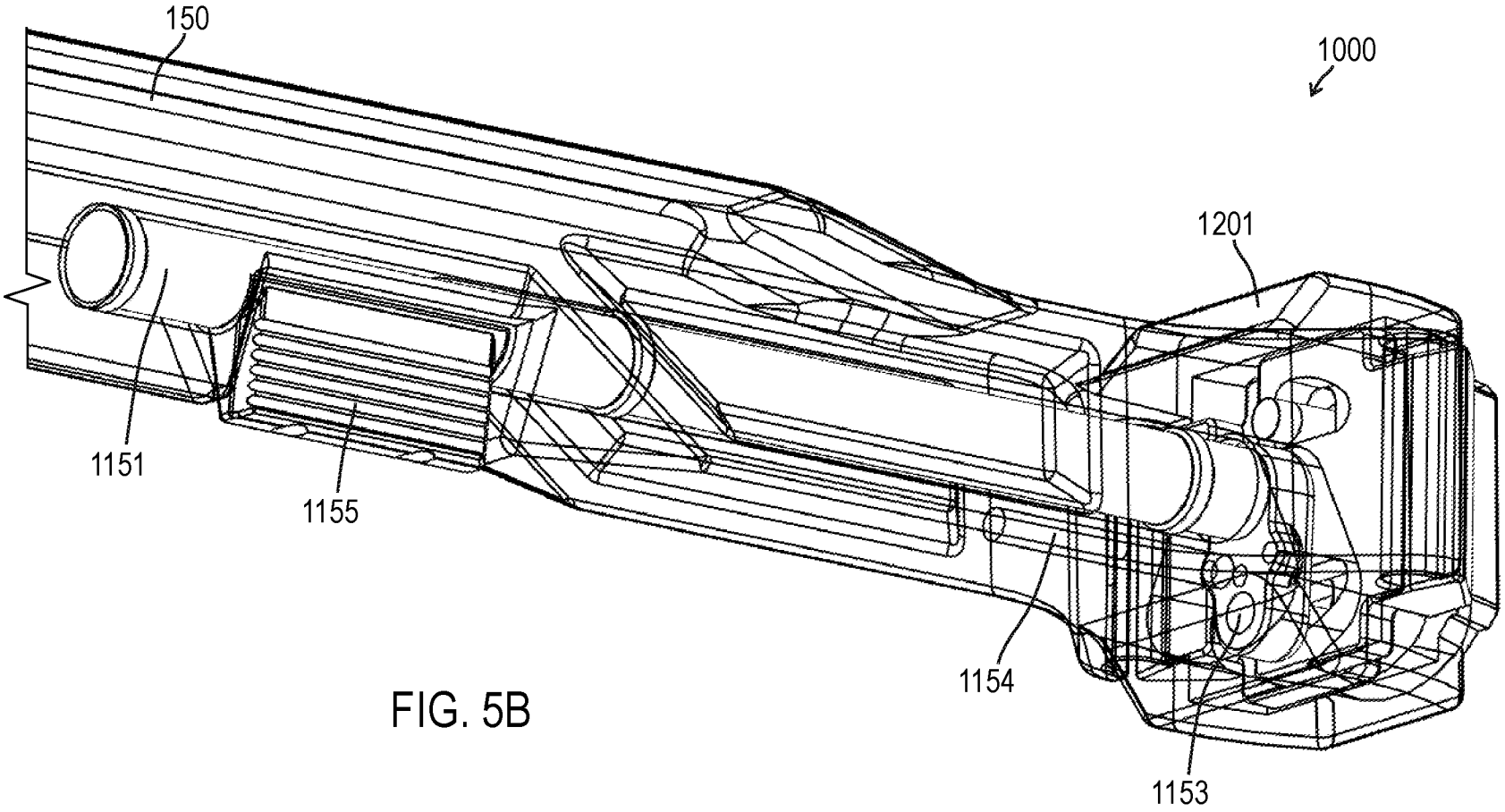
FIG. 5B is a right partial perspective view of the folding stock assembly of FIG. 5A.
Figure 5C:
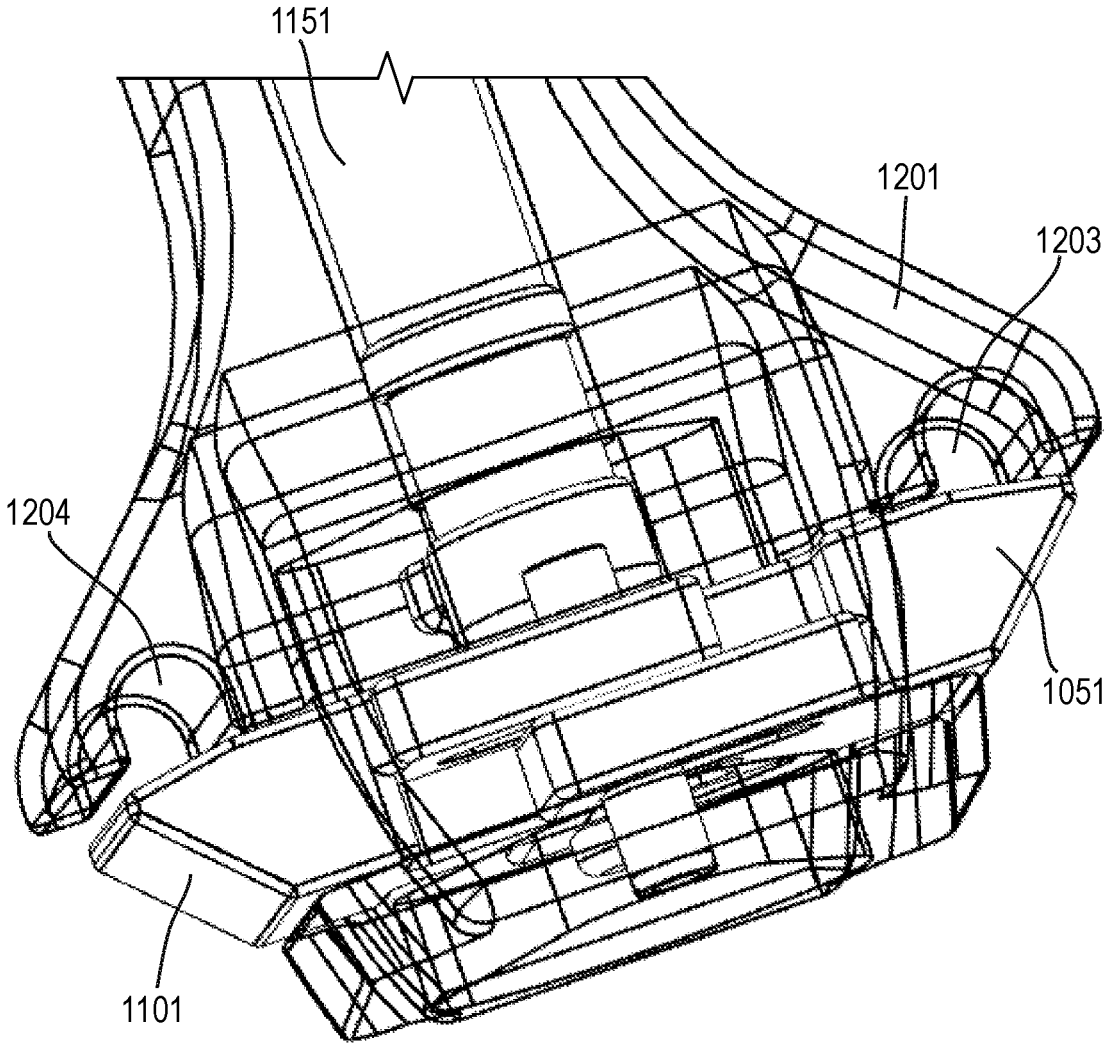
FIG. 5C is a top partial perspective view of the folding stock assembly of FIG. 5A.
Figure 6:
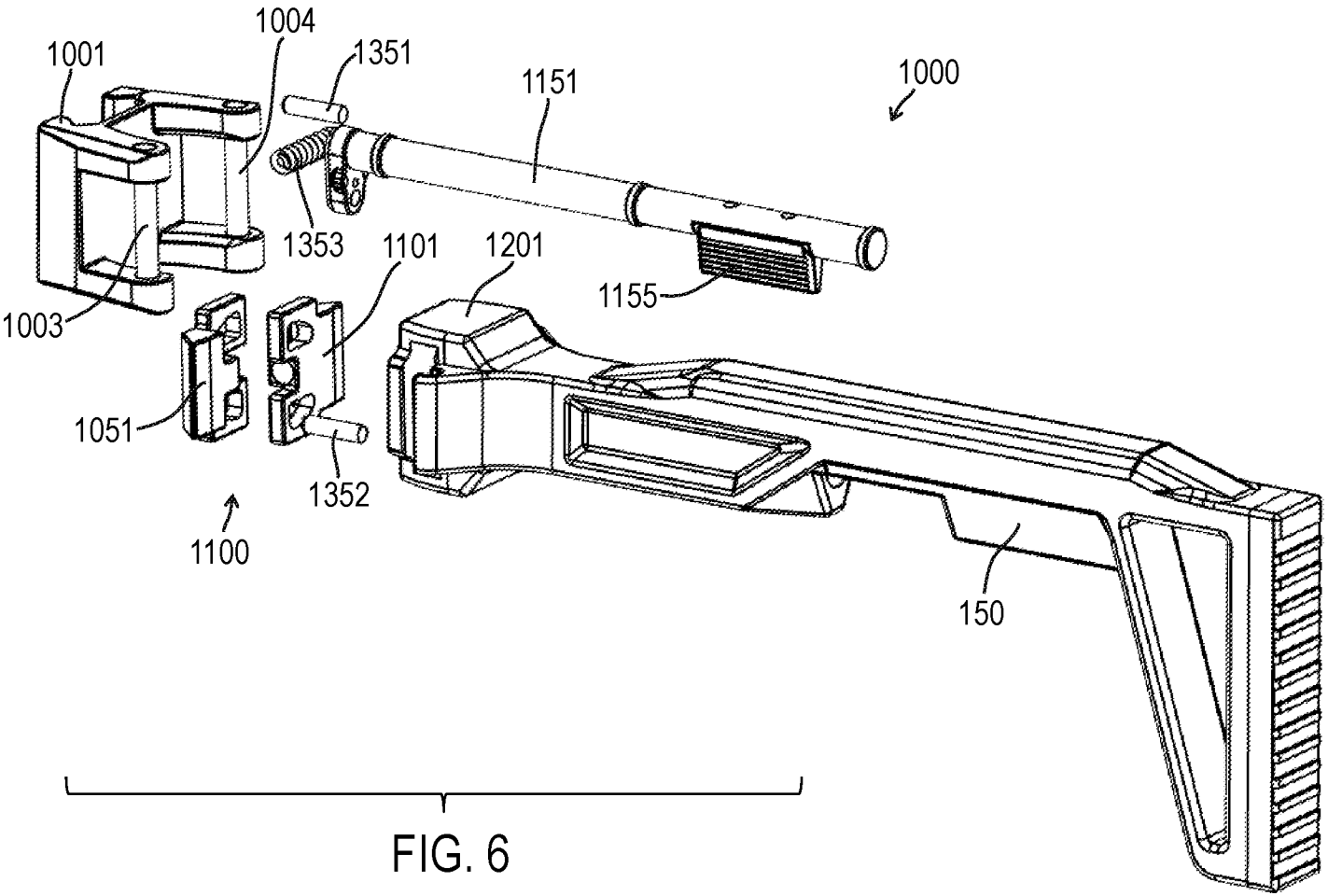
FIG. 6 is a left perspective exploded view of the folding stock assembly of FIG. 1.

In some embodiments, due to spring 1353, the fold lock mechanism 1100 is biased towards the retracted configuration such that fold lock mechanism 1100 will move back to the retracted configuration as soon as the operator releases pressure on the operating rod 1151 (e.g., releasing the paddle 1155) in any configuration of the folding stock assembly 1000. For example, FIGS. 3A-3B show the left side folded configuration of the folding stock assembly 1000 with the fold lock mechanism 1100 in the retracted configuration. Similarly, FIGS. 4A-4B show the right side folded configuration of the folding stock assembly 1000 with the fold lock mechanism 1100 in the retracted configuration. The fold lock mechanism 1100 may be designed such that the operator needs to use the operating rod 1151 to move the fold lock mechanism 1100 to the left side deployed configuration and/or the right side deployed configuration when moving the folding stock assembly 1000 back to the rearward configuration (see FIGS. 1 and 2). However, in some embodiments, the fold lock mechanism 1100 is designed to allow movement of the folding stock assembly 1000 to the rearward configuration without any manipulation of the fold lock mechanism 1100. For example, when moving from the left side folded configuration (FIGS. 3A-3B) to the rearward configuration (FIGS. 1-2), the right side moving member 1101 may be designed with a gradient surface 1105 such that contact between the right hinge pin 1004 and gradient surface 1105 causes right side moving member 1101 to move inboard (compressing spring 1353) and allowing right hinge pin 1004 to seat within right pivot hole 1204. In addition, when moving from the right side folded configuration (FIGS. 4A-4B) to the rearward configuration (FIGS. 1-2), the left side moving member 1051 may be designed with a gradient surface 1055 such that contact between the left hinge pin 1003 and gradient surface 1055 causes left side moving member 1051 to move inboard (compressing spring 1353) and allowing left hinge pin 1003 to seat within left pivot hole 1203. The gradient surfaces 1055, 1105 may include a linear (flat) ramp, a non-linear curved surface, and/or any other appropriate surface shape.

Although the folding stock assembly 1000 is designed such that it is not necessary to manipulate the fold lock mechanism 1100 to return to the rearward configuration (as described above), there may be at least one feature to ensure that the fold lock mechanism 1100 can operate and return to the retracted configuration without interfering with the hinge pins 1003, 1004. For example, the left side moving member 1051 may include an edge 1053 that is not flat or blunt for situations where the edge 1053 interfaces with the left hinge pin 1003. In addition, for situations when the left side moving member 1051 is moving back to the default outboard position, the rear surface 1054 may include a slight gradient (see FIG. 10B). The slight gradient on rear surface 1054 may function to fully seat left hinge pin 1003 within left pivot hole 1203. The right side moving member 1101 may include an edge 1103 that is not flat or blunt for situations where the edge 1103 interfaces with the right hinge pin 1004. In addition, for situations when the right side moving member 1101 is moving back to the default outboard position, the rear surface 1104 may include a slight gradient (see FIG. 11A). The slight gradient on rear surface 1104 may function to fully seat right hinge pin 1004 within right pivot hole 1204.

Figure 13A:
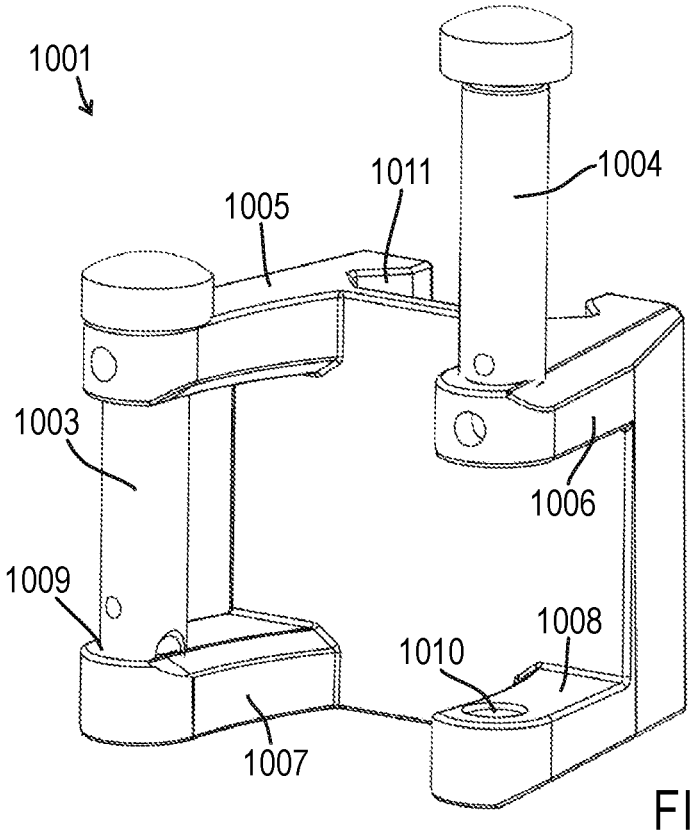
FIG. 13A is a rear perspective view of a hinge fitting of the folding stock assembly of FIG. 1.
Figure 13B:
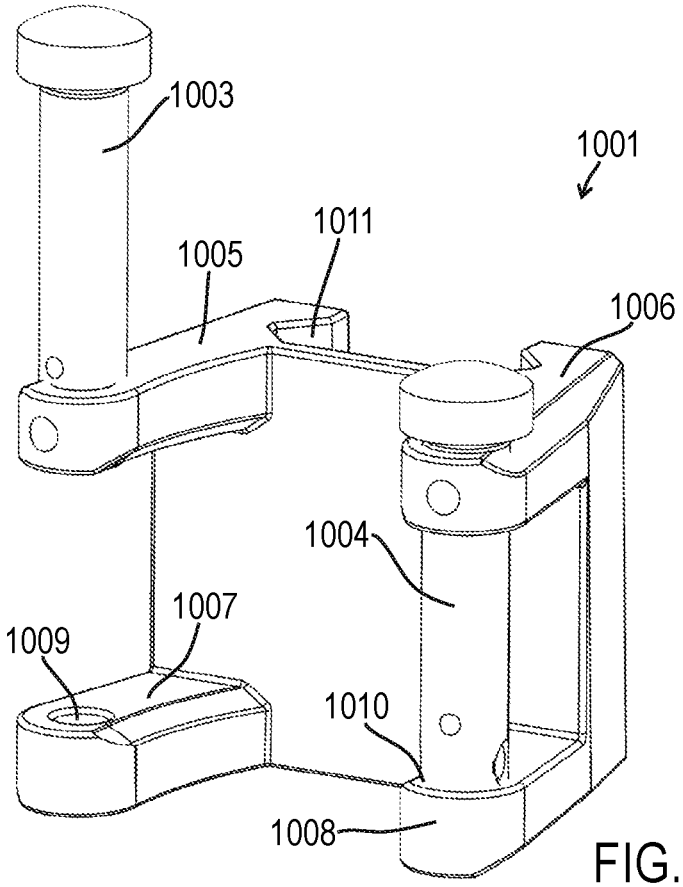
FIG. 13B is a rear perspective view of a hinge fitting of the folding stock assembly of FIG. 1.

As shown in FIGS. 13A and 13B, in some embodiments, the folding stock assembly 1000 may include at least one hinge pin 1003, 1004 designed to move relative to the hinge fitting 1001. In embodiments that include moving pins, the rear housing 1201 may be designed without any moving parts such that the left pivot hole 1203 and the right pivot hole 1204 are static holes capable of being aligned with the hinge pins 1003, 1004 (i.e., the left side moving member 1051 and the right side moving member 1101 would not be necessary). The right hinge pin 1004 may be capable of sliding within right pivot hole 1010 between an up/open position (FIG. 13A) and a down/closed position (FIG. 13B). With the right hinge pin 1004 in the up/open position shown in FIG. 13A, the rear housing 1201 can pivot about the left pivot hole 1203 (which remains coaxial with the left hinge pin 1003 and the left pivot hole 1009) to the left side folded configuration shown in FIGS. 3A and 3B. The left hinge pin 1003 may be capable of sliding within left pivot hole 1009 between an up/open position (FIG. 13B) and a down/closed position (FIG. 13A). With the left hinge pin 1003 in the up/open position shown in FIG. 13B, the rear housing 1201 can pivot about the right pivot hole 1204 (which remains coaxial with the right hinge pin 1004 and the right pivot hole 1010) to the right side folded configuration shown in FIGS. 4A and 4B. In some embodiments, the hinge fitting 1001 may be designed such that at least one of the hinge pins 1003, 1004 is a pivot pin and/or a takedown pin from an interface between a lower receiver and an upper receiver. Such a configuration utilizes existing and available components and allows for simple replacement of lost or broken components. In addition, pivot pins and/or takedown pins include interfaces for detent(s) to engage the respective pins in the up/open position and/or the down/closed position.

Figure 14A:
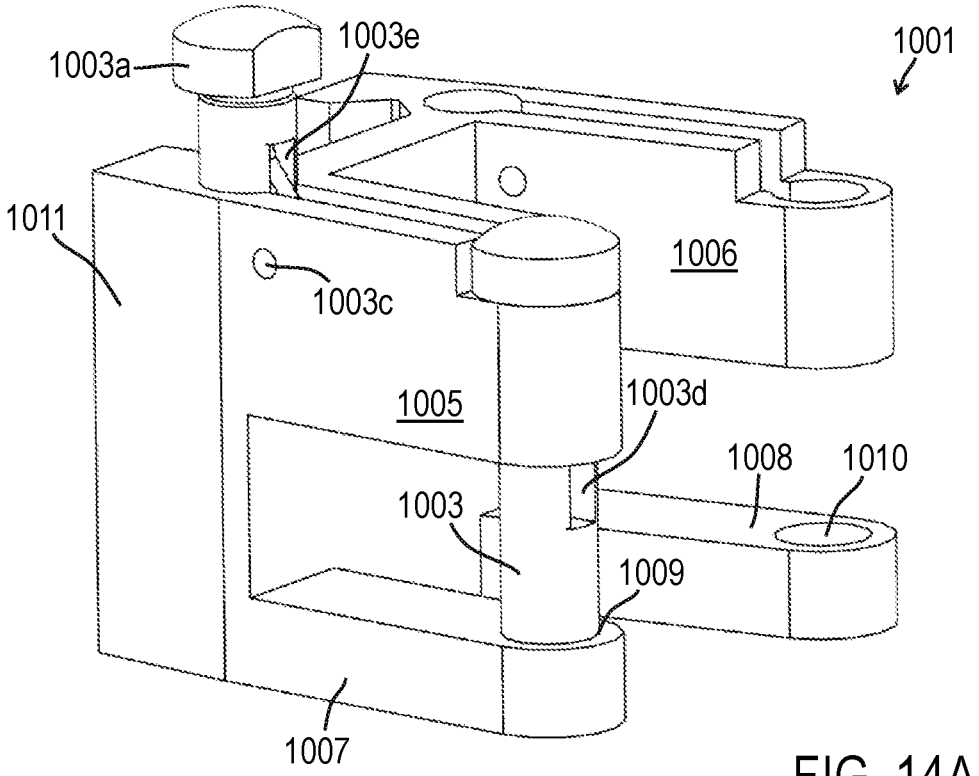
FIG. 14A is a rear perspective view of a hinge fitting of the folding stock assembly of FIG. 1.
Figure 14B:
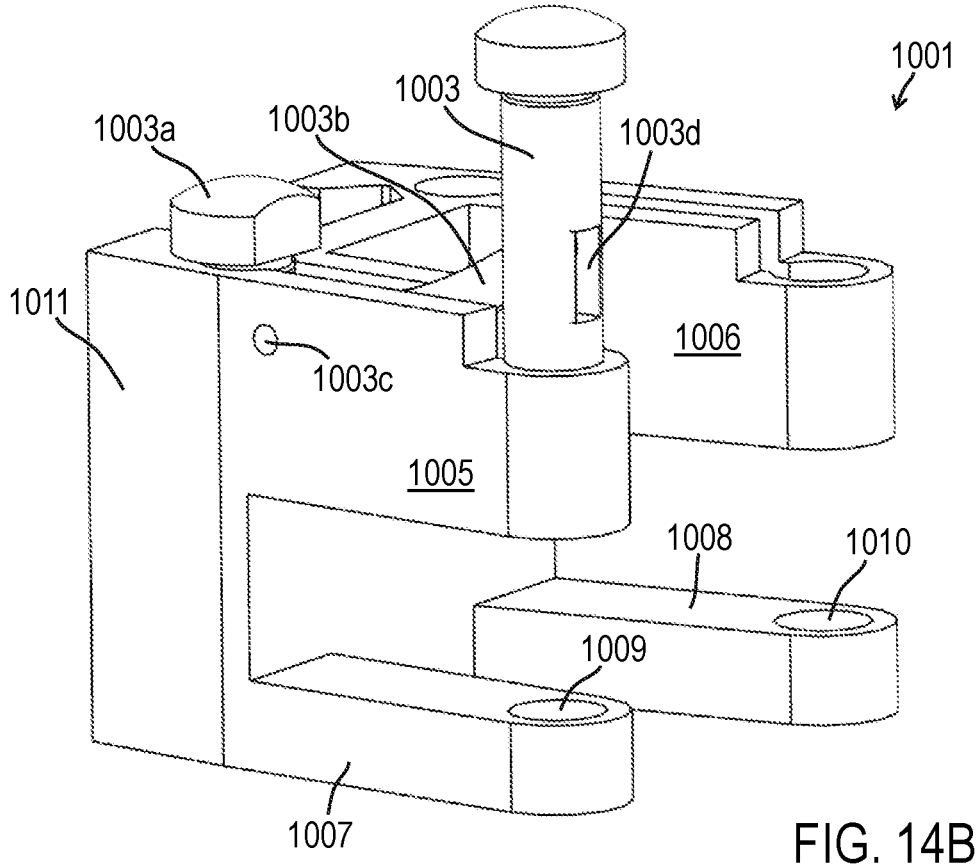
FIG. 14B is a rear perspective view of a hinge fitting of the folding stock assembly of FIG. 1.
Figure 15:
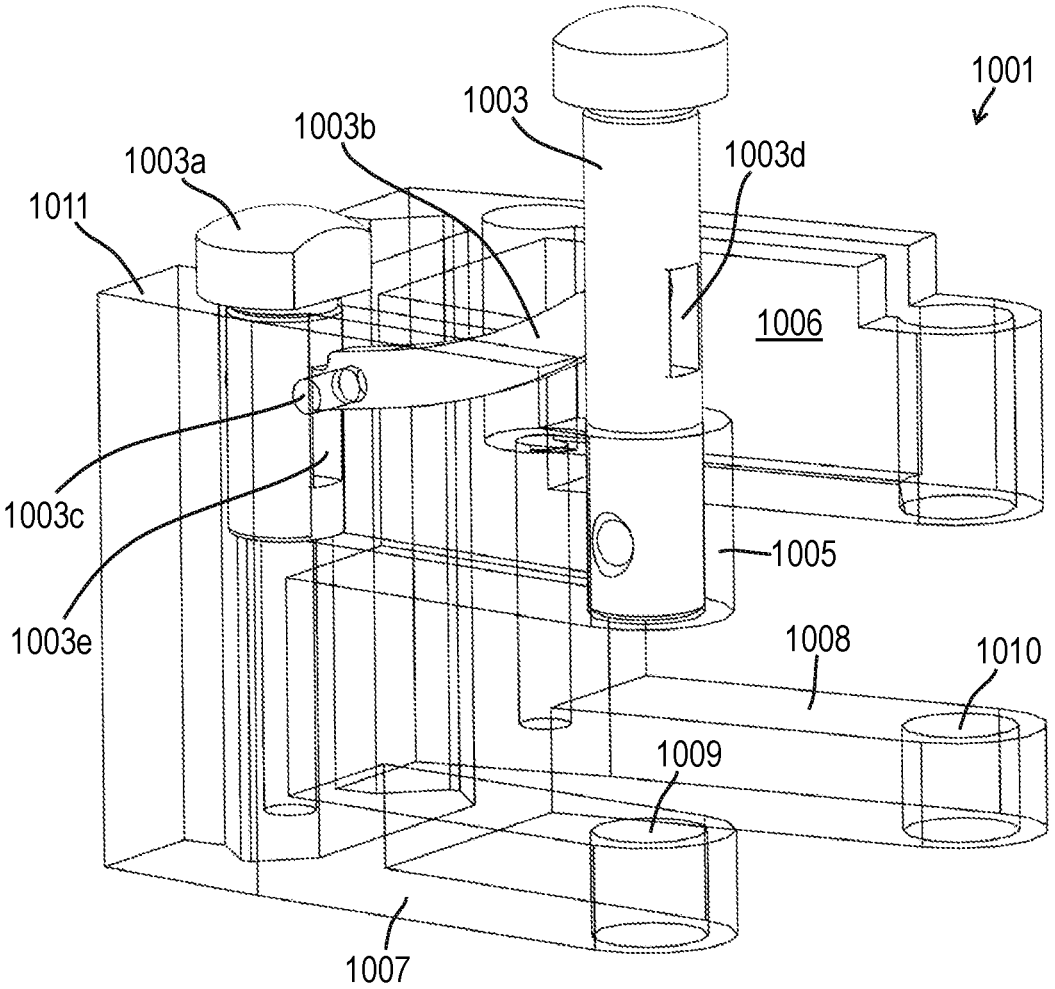
FIG. 15 is a rear perspective view of a hinge fitting of the folding stock assembly of FIG. 1.

In some embodiments, as shown in FIGS. 14A-15, the folding stock assembly 1000 may include at least one hinge pin 1003, 1004 designed to move relative to the hinge fitting 1001 where the hinge fitting 1001 has a mechanism for moving the at least one hinge pin. As one example, the hinge fitting 1001 may include a mechanism with a button 1003*a*, a lever 1003*b*, and a pivot pin 1003*c*. The left hinge pin 1003 may be capable of sliding within left pivot hole 1009 between an up/open position (FIG. 14B) and a down/closed position (FIG. 14A). In some embodiments, motion of the hinge pin 1003 is controlled by movement of the button 1003*a* and the lever 1003*b*. For example, the operator may push the button 1003*a* down such that slot 1003*e* of button 1003*a* engages a first end of the lever 1003*b* and causes the lever 1003*b* to pivot about pin 1003*c*. The pivoting of the lever 1003*b* causes a second end of the lever 1003*b* to engage slot 1003*d* of the hinge pin 1003 such that the lever 1003*b* raises the hinge pin 1003. In FIG. 15, the hinge fitting 1001 is transparent to illustrate the mechanism. With the left hinge pin 1003 in the up/open position shown in FIGS. 14B and 15, the rear housing 1201 can pivot about the right pivot hole 1204 (which remains coaxial with the right hinge pin 1004 and the right pivot hole 1010) to the right side folded configuration shown in FIGS. 4A and 4B. The right hinge pin 1004 may include a similar mechanism that functions in a similar manner.

The components of any of the firearm and/or the folding stock assemblies 1000 described herein may be formed of materials including, but not limited to, thermoplastic, carbon composite, plastic, nylon, steel, aluminum, stainless steel, tool steel, high strength aluminum alloy, other plastic or polymer materials, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An ambidextrous folding stock assembly for a firearm comprising:

a hinge fitting attached to the firearm;

a left hinge pin disposed on a left side of the hinge fitting;

a right hinge pin disposed on a right side of the hinge fitting;

at least one moving member;

a rear housing disposed on a rear side of the hinge fitting;

a fold lock mechanism comprising an operating rod, wherein the fold lock mechanism controls movement of the at least one moving member;

a rearward configuration wherein the rear housing is connected to both the left hinge pin and the right hinge pin;

a left side folded configuration wherein the rear housing is connected to the left hinge pin and the rear housing is moved toward a left side of the firearm; and a right side folded configuration wherein the rear housing is connected to the right hinge pin and the rear housing is moved toward a right side of the firearm, wherein:

the fold lock mechanism controls movement between the rearward configuration, the left side folded configuration, and the right side folded configuration; and at least a portion of the operating rod comprises an axial direction that extends rearward from the rear housing.

2. The ambidextrous folding stock assembly of claim 1, further comprising a stock attached to the rear housing, wherein:

the rear housing and the stock are configured to pivot about the left hinge pin; and the rear housing and the stock are configured to pivot about the right hinge pin.

3. The ambidextrous folding stock assembly of claim 1, wherein the at least one moving member comprises a left side moving member and a right side moving member.

4. The ambidextrous folding stock assembly of claim 3, wherein:

the left side moving member is movable such that the left hinge pin is removable from the rear housing based on movement of the left side moving member; and the right side moving member is movable such that the right hinge pin is removable from the rear housing based on movement of the right side moving member.

5. The ambidextrous folding stock assembly of claim 1, wherein the at least one moving member is movable in a horizontal direction relative to the rear housing.

6. The ambidextrous folding stock assembly of claim 1, further comprising a fold lock mechanism, wherein the fold lock mechanism comprises a retracted configuration, a left deployed configuration, and a right deployed configuration.

7. The ambidextrous folding stock assembly of claim 1, wherein the operating rod comprises a paddle such that an operator can push the paddle to cause the operating rod to rotate about the axial direction.

8. The ambidextrous folding stock assembly of claim 1, wherein the operating rod comprises at least one stud extending forward such that movement of the operating rod causes the at least one stud to push the at least one moving member in a lateral direction.

9. The ambidextrous folding stock assembly of claim 1, wherein:

the ambidextrous folding stock assembly is configured to rotate toward the left side folded configuration about the left hinge pin; and the ambidextrous folding stock assembly is configured to rotate toward the right side folded configuration about the right hinge pin.

10. An ambidextrous folding stock assembly for a firearm comprising:

a hinge fitting attached to the firearm;

a rear housing disposed on a rear side of the hinge fitting;

a plurality of hinge pins extending through at least a portion of the hinge fitting and through at least a portion of the rear housing; and a fold lock mechanism comprising an operating rod with a longitudinal axis, wherein the fold lock mechanism controls movement of the rear housing relative to the hinge fitting, wherein:

the operating rod is configured to rotate about the longitudinal axis; and the ambidextrous folding stock assembly is configured to rotate in a different direction about each of the plurality of hinge pins.

11. The ambidextrous folding stock assembly of claim 10, wherein the plurality of hinge pins comprises at least one selected from the group of a pivot pin or a takedown pin.

12. The ambidextrous folding stock assembly of claim 10, further comprising at least one moving member.

13. The ambidextrous folding stock assembly of claim 12, wherein the at least one moving member comprises a left side moving member and a right side moving member.

14. The ambidextrous folding stock assembly of claim 13, wherein:

the left side moving member is movable such that the left hinge pin is removable from the rear housing based on movement of the left side moving member; and the right side moving member is movable such that the right hinge pin is removable from the rear housing based on movement of the right side moving member.

15. The ambidextrous folding stock assembly of claim 10, wherein the plurality of hinge pins comprises:

a left hinge pin disposed on a left side of the hinge fitting; and a right hinge pin disposed on a right side of the hinge fitting.

16. The ambidextrous folding stock assembly of claim 15, wherein:

the ambidextrous folding stock assembly is configured to rotate toward a left side of the firearm about the left hinge pin; and the ambidextrous folding stock assembly is configured to rotate toward a right side of the firearm about the right hinge pin.

17. The ambidextrous folding stock assembly of claim 15, further comprising:

a rearward configuration wherein the rear housing is connected to both the left hinge pin and the right hinge pin;

a left side folded configuration wherein the rear housing is connected to the left hinge pin and the rear housing is moved toward a left side of the firearm; and a right side folded configuration wherein the rear housing is connected to the right hinge pin and the rear housing is moved toward a right side of the firearm.

18. The ambidextrous folding stock assembly of claim 10, wherein at least a portion of the operating rod comprises an axial direction that extends rearward from the rear housing.

19. The ambidextrous folding stock assembly of claim 10, wherein the operating rod comprises a paddle such that an operator can push the paddle to cause the operating rod to rotate.

20. The ambidextrous folding stock assembly of claim 10, wherein the operating rod comprises at least one stud extending forward such that movement of the operating rod causes the at least one stud to push the at least one moving member in a lateral direction.

* * * * *